US005449594A

United States Patent [19]

Ueda et al.

[11] Patent Number: 5,449,594

[45] Date of Patent: * Sep. 12, 1995

[54] SILVER HALIDE COLOR PHOTOGRAPHIC LIGHT-SENSITIVE MATERIAL

[75] Inventors: Fumitaka Ueda; Junji Nishigaki, both of Minami-Ashigara, Japan

[73] Assignee: Fuji Photo Film Co., Ltd., Kanagawa, Japan

[ * ] Notice: The portion of the term of this patent subsequent to Jan. 24, 2012 has been disclaimed.

[21] Appl. No.: 159,748

[22] Filed: Dec. 1, 1993

[30] Foreign Application Priority Data

Dec. 3, 1992 [JP] Japan ..... 4-349998

[51] Int. Cl.[6] ..... G03C 1/18; G03C 1/46; G03C 1/83

[52] U.S. Cl. ..... 430/504; 430/522; 430/588

[58] Field of Search ..... 430/505, 522, 588

[56] References Cited

U.S. PATENT DOCUMENTS

| | | | |
|---|---|---|---|
| 3,933,510 | 1/1976 | Shiba et al. | 430/574 |
| 4,904,578 | 2/1990 | Tanaka | 430/507 |
| 5,053,324 | 10/1991 | Sasaki | 430/504 |
| 5,198,332 | 3/1993 | Ikagawa et al. | 430/588 |
| 5,213,957 | 5/1993 | Adachi | 430/522 |
| 5,296,344 | 3/1994 | Jimbo et al. | 430/522 |

FOREIGN PATENT DOCUMENTS 0430186 6/1991 European Pat. Off. .

*Primary Examiner*—Janet C. Baxter

*Attorney, Agent, or Firm*—Sughrue, Mion, Zinn, Macpeak & Seas

[57] ABSTRACT

A silver halide color photographic light-sensitive material includes a support having provided thereon at least one blue-sensitive silver halide emulsion layer, at least one green-sensitive silver halide emulsion layer, at least one red-sensitive silver halide emulsion layer, and at least one hydrophilic colloid layer. The hydrophilic colloid layer contains a compound represented by Formula I below, a silver halide emulsion layer having an interlayer effect on the red-sensitive layer is also provided, and the layer with the interlayer effect contains a silver halide emulsion spectrally sensitized with a sensitizing dye represented by Formula (III) below.

7 Claims, No Drawings

SILVER HALIDE COLOR PHOTOGRAPHIC LIGHT-SENSITIVE MATERIAL

BACKGROUND OF THE INVENTION

1. Field of the Invention

The present invention relates to a silver halide color photographic light-sensitive material and, more particularly, to a silver halide color photographic light-sensitive material which has a good color reproduction and also has a high speed and a high graininess.

2. Description of the Related Art

Conventionally, the use of an interlayer inhibiting effect (interlayer effect) is known as means of improving color reproduction in silver halide color photographic light-sensitive materials.

In the case of color negative light-sensitive materials, by allowing a green-sensitive layer to have a development inhibiting effect on a red-sensitive layer, the color formation of the red-sensitive layer in white exposure can be suppressed to be lower than that in red exposure. Likewise, a development inhibiting effect that the red-sensitive layer has on the green-sensitive layer can yield the reproduction of green with a high saturation.

If, however, the saturations of three primary colors, red, green, and blue, are increased by using these methods, hues from yellow to cyan green lose their fidelities, and so the technique described in JP-A-61-34541 ("JP-A" means Published Unexamined Japanese Patent Application) has been proposed as a countermeasure. This technique aims to achieve a fresh, high-fidelity color reproduction in a silver halide color light-sensitive material comprising a support having provided thereon at least one blue-sensitive silver halide emulsion layer containing a color coupler for forming a yellow color, at least one green-sensitive silver halide emulsion layer containing a color coupler for forming a magenta color, and at least one red-sensitive silver halide emulsion layer containing a color coupler for forming a cyan color, wherein the barycentric sensitivity wavelength (barycenter $\lambda_G$l) of the spectral sensitivity distribution of the green-sensitive layer is 520 nm$\leqq$barycenter $\lambda_G \leqq 580$ nm, the barycentric wavelength (barycenter $\lambda_{-R}$) of the distribution of magnitudes of an interlayer effect which a given layer has on at least one red-sensitive silver halide emulsion layer at a wavelength ranging from 500 nm to 600 nm is 500 nm$<$barycenter $\lambda_{-R} \leqq 600$ nm, and barycentric input $_G$—barycenter $\lambda_{-R} \leqq 5$ nm.

When, however, photography was performed by using light-sensitive materials manufactured as described above and the consequent color prints were evaluated, it was found that the graininess of the silver halide emulsion layer having the interlayer effect on the red-sensitive layer was lower than those of the other color-sensitive layers.

The reason for this is estimated that the absorption of sensitizing dyes conventionally used is weak in the layer with the interlayer effect and a yellow filter layer cuts more light around 500 nm than is necessary.

SUMMARY OF THE INVENTION

It is, therefore, an object of the present invention to provide a silver halide photographic light-sensitive material which has a good color reproduction and also has a high speed and a high graininess.

The above object of the present invention is achieved by the following means.

A silver halide color photographic light-sensitive material comprising a support having provided thereon at least one blue-sensitive silver halide emulsion layer, at least one green-sensitive silver halide emulsion layer, at least one red-sensitive silver halide emulsion layer, and at least one hydrophilic colloid layer, wherein the hydrophilic colloid layer contains a compound represented by Formula (I) below, a silver halide emulsion layer having an interlayer effect on the red-sensitive layer is also provided, and the layer with the interlayer effect contains a silver halide emulsion spectrally sensitized with a sensitizing dye represented by Formula (II) or (III) below.

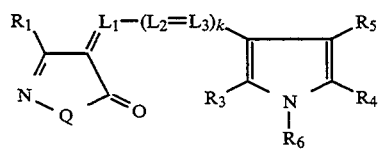

Formula (I)

In this Formula (I), $R_1$ represents a hydrogen atom, alkyl, alkenyl, aryl, a heterocyclic ring, ureido, sulfonamide, sulfamoyl, sulfonyl, sulfinyl, alkylthio, arylthio, oxycarbonyl, acyl, carbamoyl, cyano, alkoxy, aryloxy, amino, or amide, and Q represents —O— or —$NR_2$- wherein $R_2$ represents a hydrogen atom, alkyl, aryl, or a heterocyclic group.

$R_3$, $R_4$, and $R_5$ each represent a hydrogen atom, alkyl, or aryl, and $R_4$ and $R_5$ may be bonded to each other to form a 6-membered ring.

$R_6$ represents a hydrogen atom, alkyl, aryl, or amino.

$L_1$, $L_2$, and $L_3$ each represent methine, and k is an integer of 0 or 1.

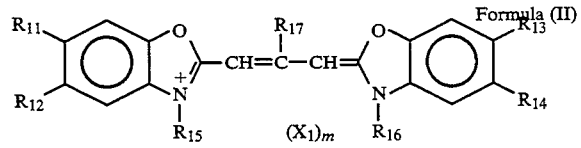

Formula (II)

In this Formula (II), $R_{11}$, $R_{12}$, $R_{13}$, and $R_{14}$ may be the same or different and each represent a hydrogen atom, a halogen atom, alkyl, aryl, alkoxy, aryloxy, aryloxycarbonyl, alkoxycarbonyl, amino, acyl, cyano, carbamoyl, sulfamoyl, carboxyl, or an acyloxy group.

$R_{11}$ and $R_{12}$ or $R_{13}$ and $R_{14}$ do not represent a hydrogen atom simultaneously.

$R_{15}$ and $R_{16}$ may be the same or different and each represent an alkyl group.

$R_{17}$ represents an alkyl having three or more carbon atoms, aryl, or aralkyl group.

$X_1$ represents a counter anion, and m is an integer of 0 or 1, and m=0 when intramolecular salt is to be formed.

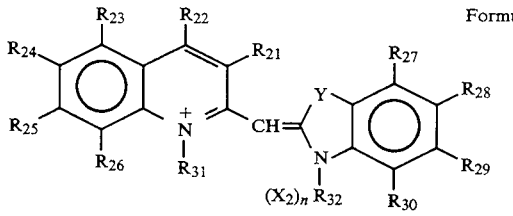

Formula (III)

In this Formula (III), $R_{21}$, $R_{22}$, $R_{23}$, $R_{24}$, $R_{25}$, $R_{26}$, $R_{27}$, $R_{28}$, $R_{29}$, and $R_{30}$ each have the same meaning as that of $R_{11}$, $R_{31}$ and $R_{32}$ each have the same meaning as that of $R_{15}$.

Y represents a sulfur atom, a selenium atom, or an oxygen atom, $X_2$ has the same meaning as that of $X_1$, and n has the same meaning as that of m.

DETAILED DESCRIPTION OF THE INVENTION

The present invention will be described in more detail below.

The light-sensitive material of the present invention is a color light-sensitive material comprising a support having provided thereon at least one blue-sensitive silver halide emulsion layer containing a color coupler for forming a yellow color, at least one green-sensitive silver halide emulsion layer containing a color coupler for forming a magenta color, at least one red-sensitive silver halide emulsion layer containing a color coupler for forming a cyan color, and at least one hydrophilic colloid layer, and the first characteristic feature of this light-sensitive material is that the hydrophilic colloid layer contains a compound represented by Formula (I) below.

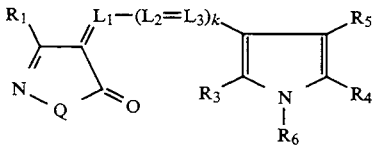

Formula (I)

In this Formula (I), $R_1$ represents a hydrogen atom, alkyl, alkenyl, aryl, a heterocyclic ring, ureido, sulfonamide, sulfamoyl, sulfonyl, sulfinyl, alkylthio, arylthio, oxycarbonyl, acyl, carbamoyl, cyano, alkoxy, aryloxy, amino, or amide, Q represents —O— or —$NR_2$-wherein $R_2$ represents a hydrogen atom, alkyl, aryl, or a heterocyclic group.

$R_3$, $R_4$, and $R_5$ each represent a hydrogen atom, alkyl, or aryl, and $R_4$ and $R_5$ may be bonded to each other to form a 6-membered ring.

$R_6$ represents a hydrogen atom, alkyl, aryl, or amino.

$L_1$, $L_2$, and $L_3$ each represent methine, and k is an integer of 0 or 1.

When the above compound is used as a filter dye, the compound can be used in a given effective amount, but the compound is preferably used such that an optical density ranges between 0.05 and 3.0. The use amount is preferably 1 to 1,000 mg per 1 $m^2$ of the light-sensitive material.

When the compound is used as a component other than the filter dye, the compound can also be used in a given effective amount. A practical use amount in this case is the same as the described above.

The dye represented by Formula (I) of the present invention can be dispersed in the hydrophilic colloid layer (e.g., an interlayer, a protective layer, an antihalation layer, and a filter layer) through various conventional methods. A practical example is the method described in JP-A-3-173383.

Although the dye according to the present invention can be dispersed in emulsion layers and other hydrophilic colloid layers, it is preferred to disperse the dye in a layer farther from a support than a green-sensitive silver halide emulsion layer. In a light-sensitive material having a yellow filter layer, the dye is most preferably dispersed in this yellow filter layer. This is so because the dye of the present invention has a sharper light absorption for a particular wavelength than that of yellow colloidal silver and therefore a sensitivity is raised in a green-sensitive emulsion layer more significantly when the dye is used in the yellow filter layer than when colloidal silver is used.

Practical examples of a compound represented by Formula (I) of the present invention are presented below, but the invention is not limited to these examples.

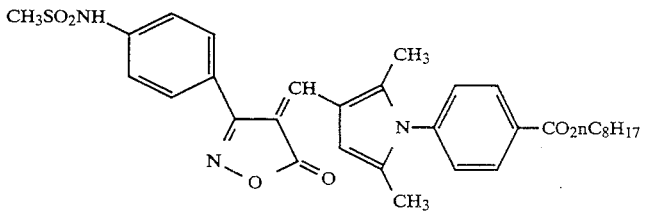

D-101

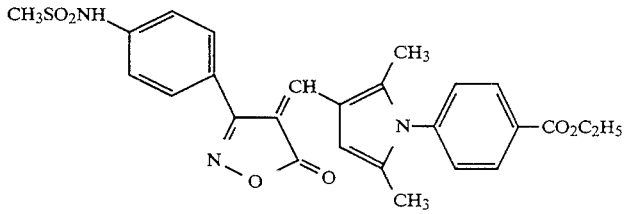

D-102

-continued
D-103
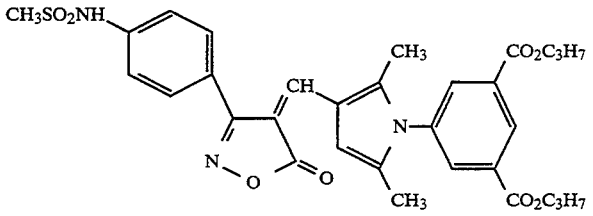
D-104
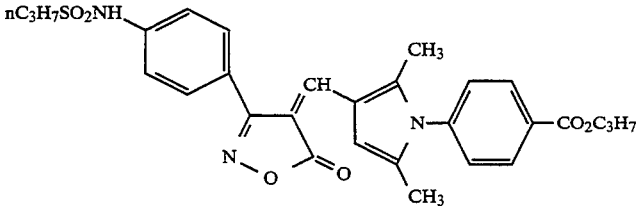
D-105
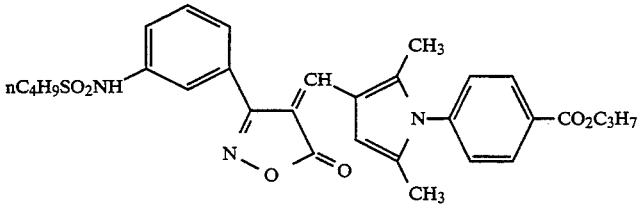
D-106
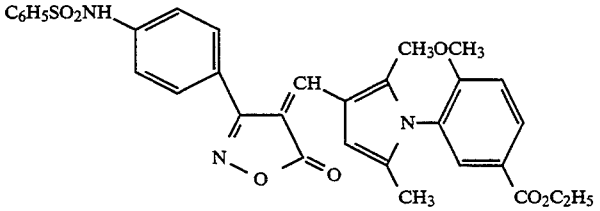
D-107
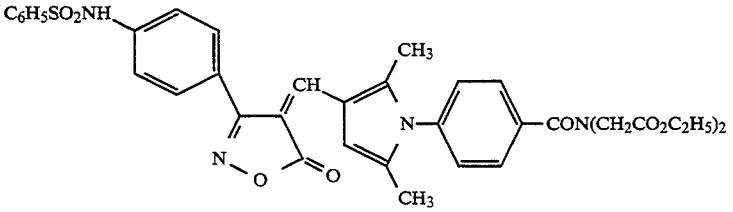
D-108
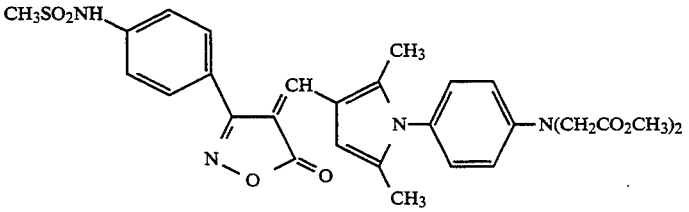
D-109
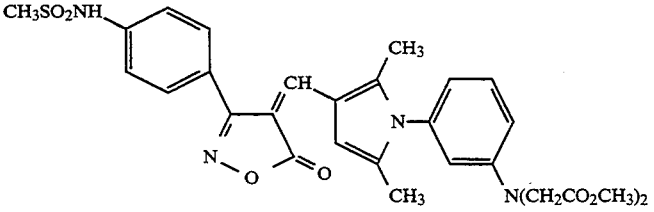

-continued
D-110
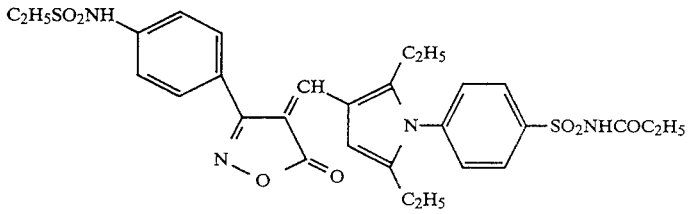
D-111
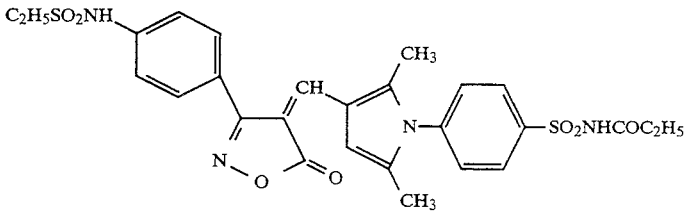
D-112
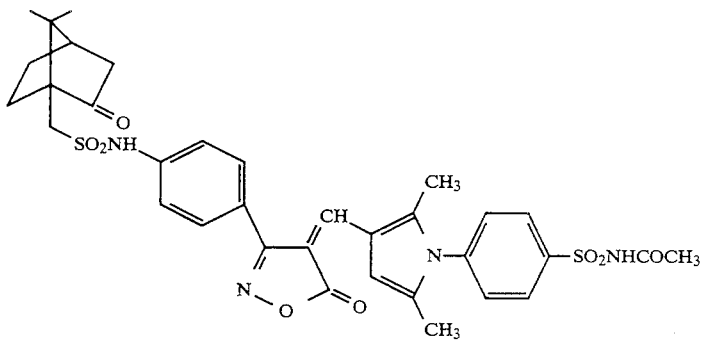
D-113
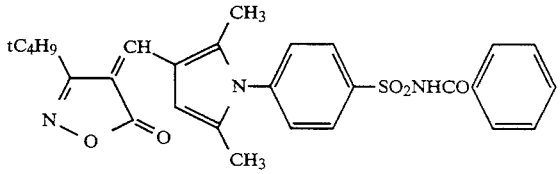
D-114
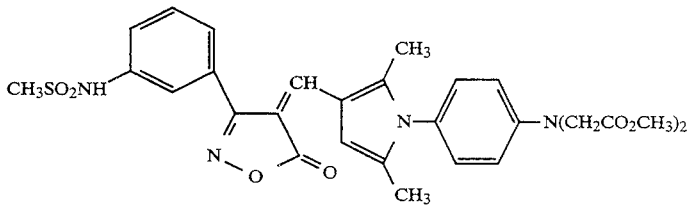
D-115
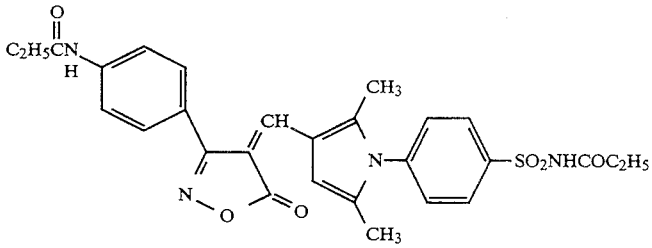
D-116
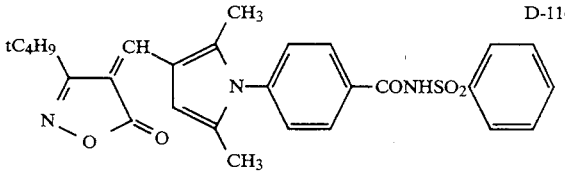
D-117
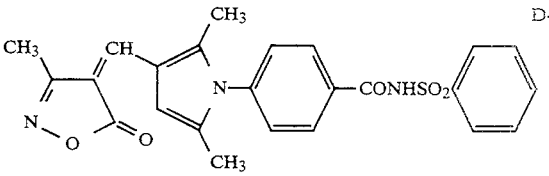

-continued
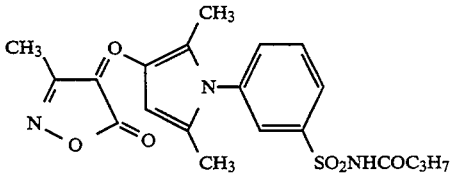
D-118 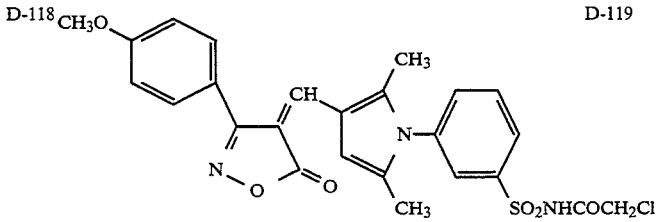
D-119
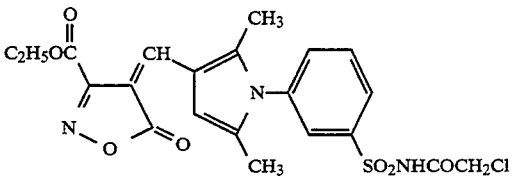
D-120 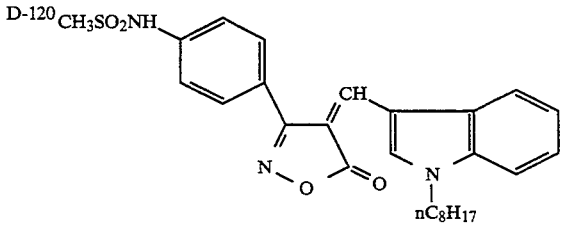
D-121
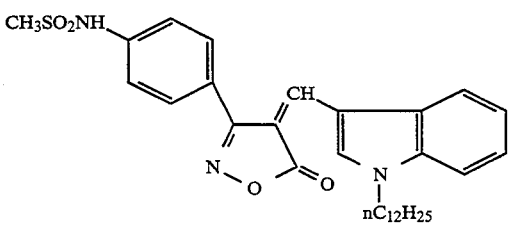
D-122
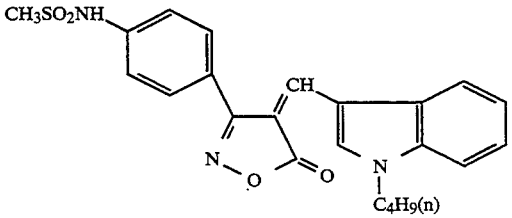
D-123 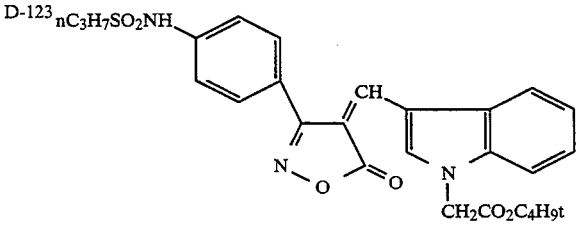
D-124
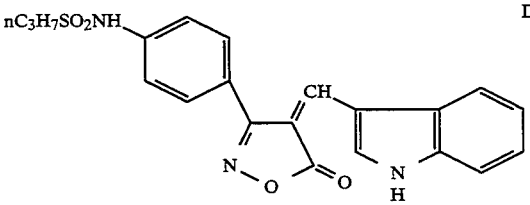
D-125 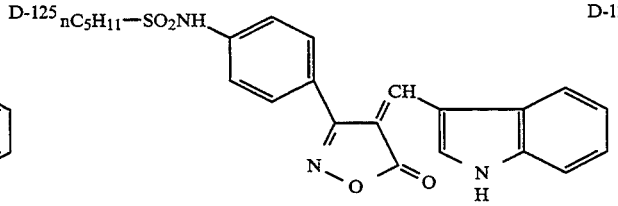
D-126
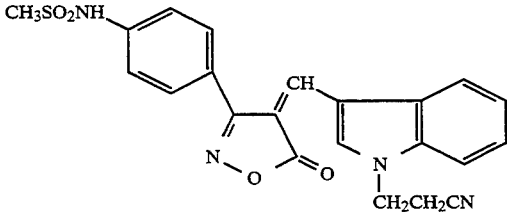
D-127
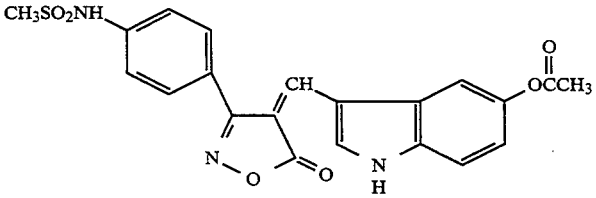
D-128

-continued
D-129
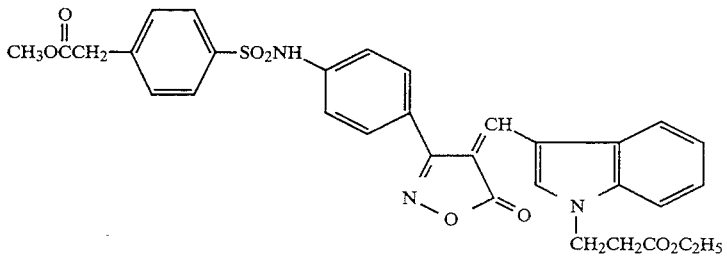
D-130
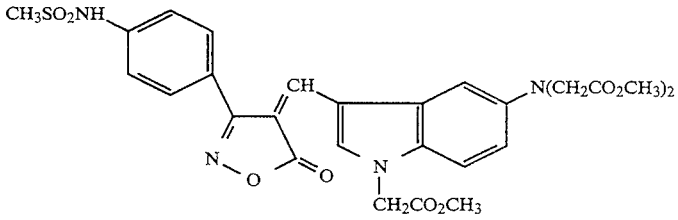
D-131
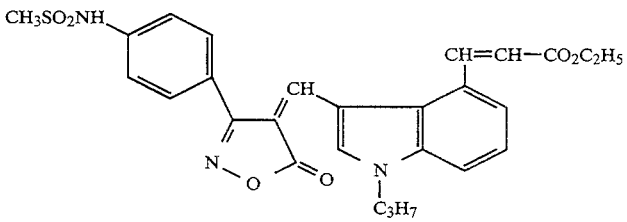
D-132
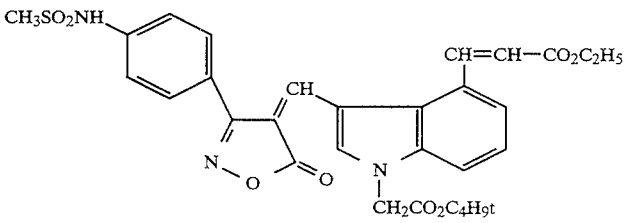
D-133
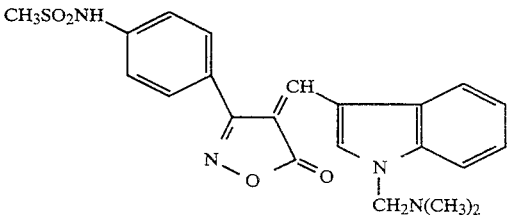
D-134
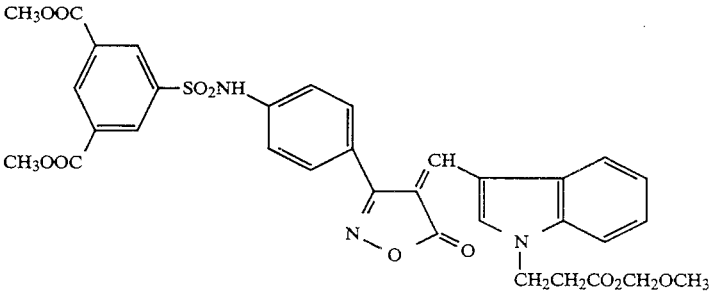

-continued
D-135
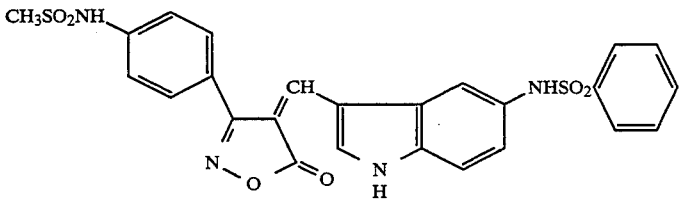
D-136
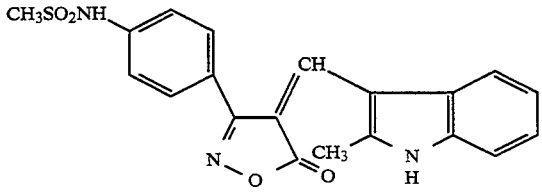
D-137
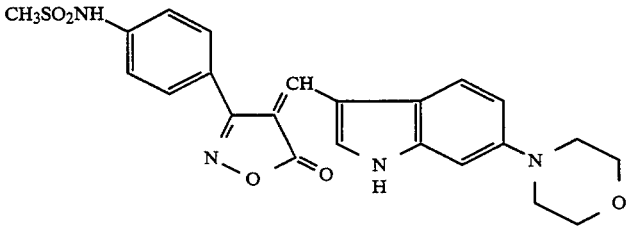
D-138
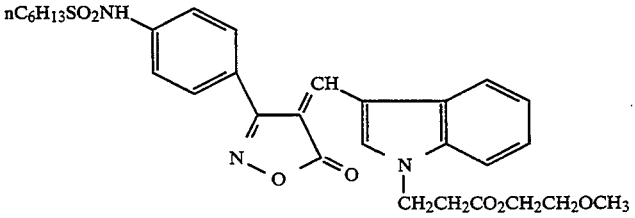
D-139
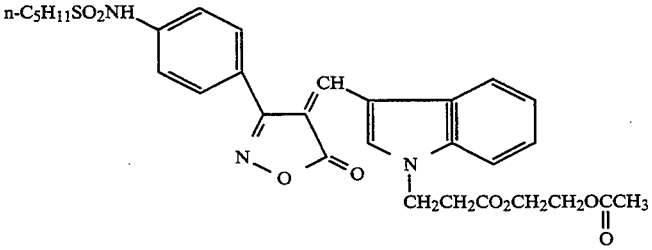
D-140
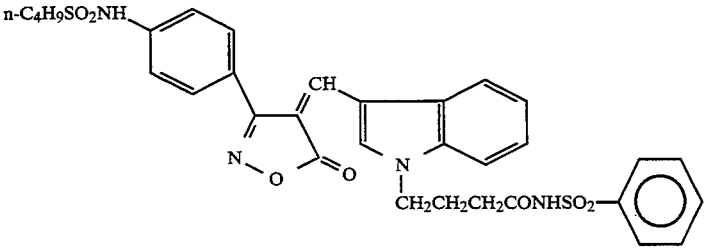
D-141
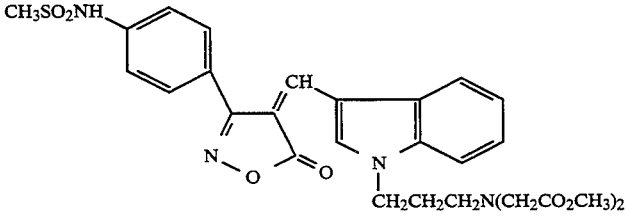

-continued
D-142
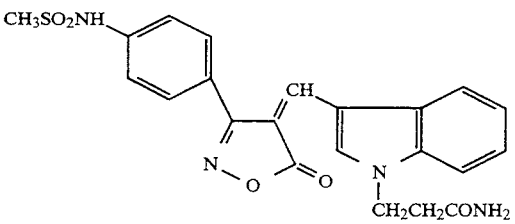
D-143
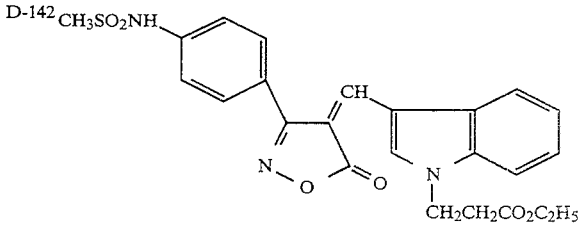
D-144
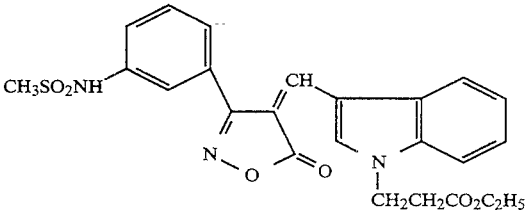
D-145
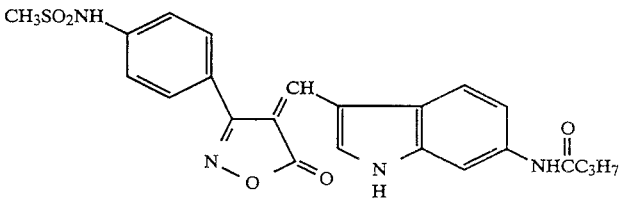
D-146
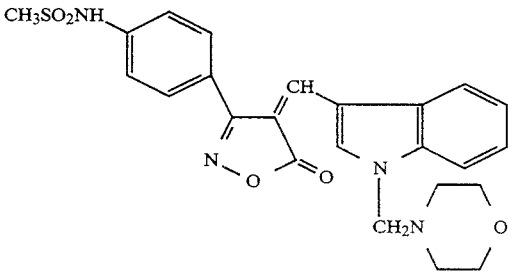
D-147
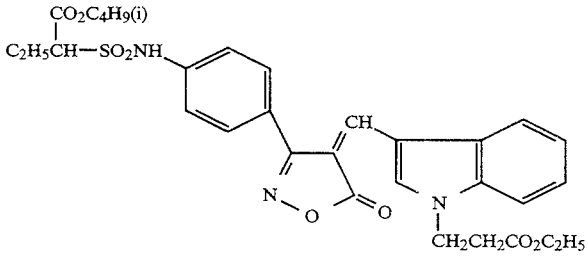
D-148
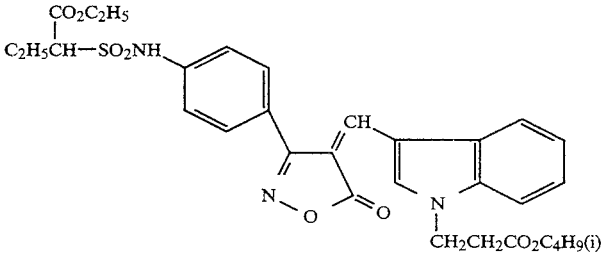

-continued
D-149
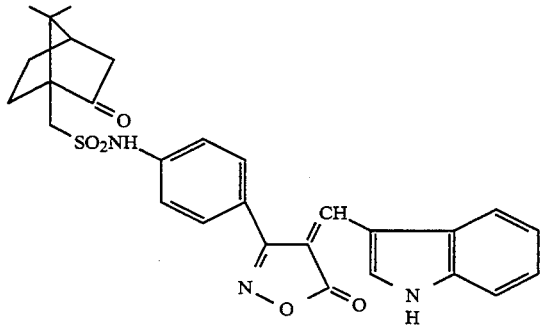
D-150
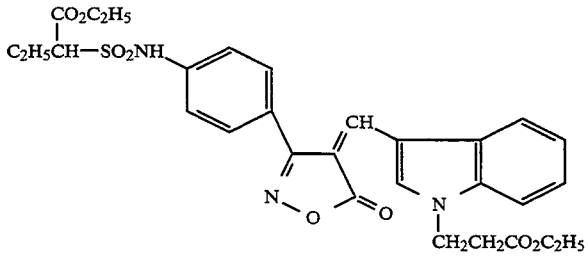
D-151
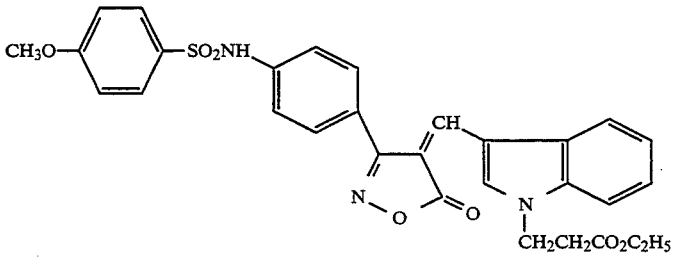
D-152
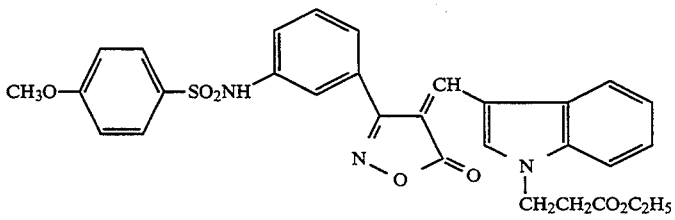
D-153
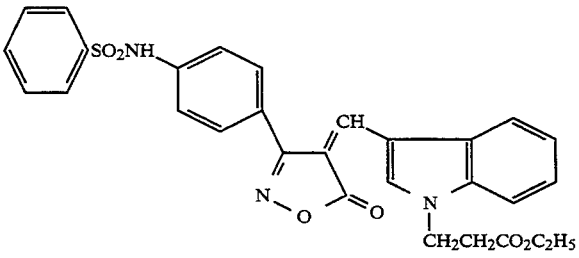
D-154
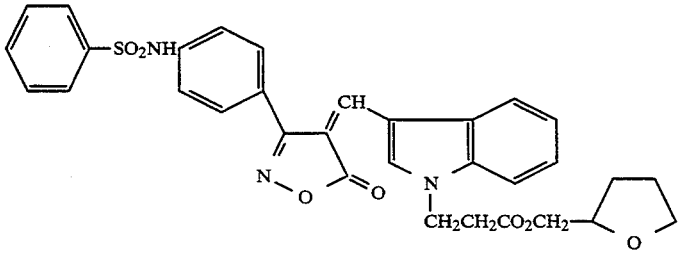

-continued
D-155
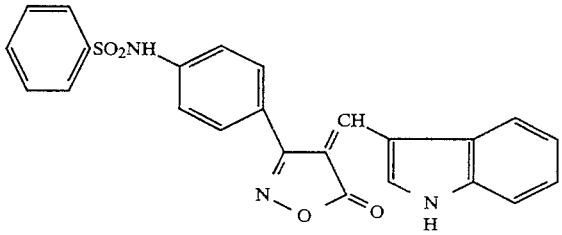
D-156
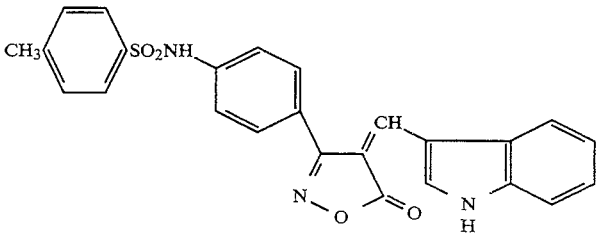
D-157
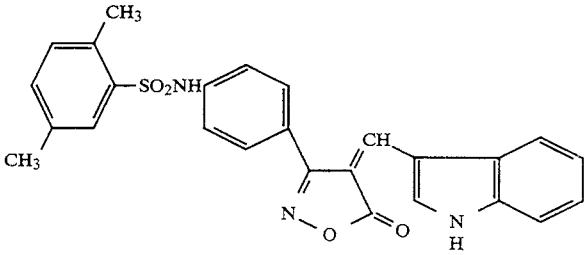
D-158
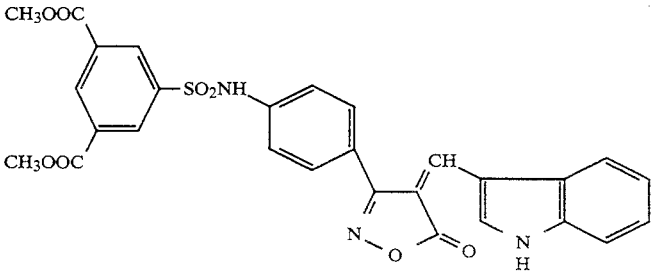
D-159
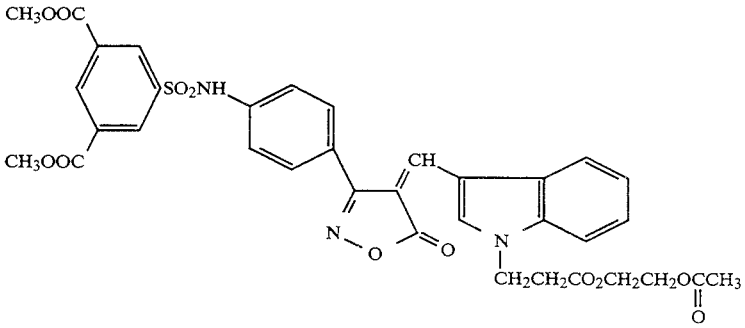
D-160
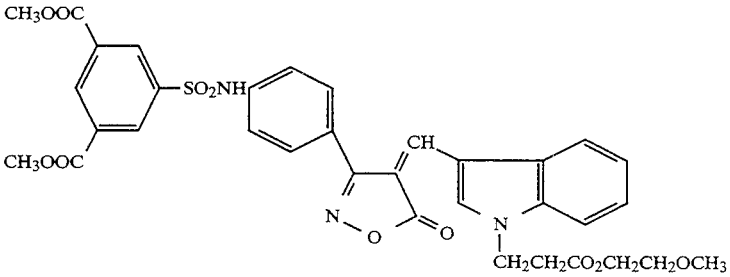

-continued
D-161
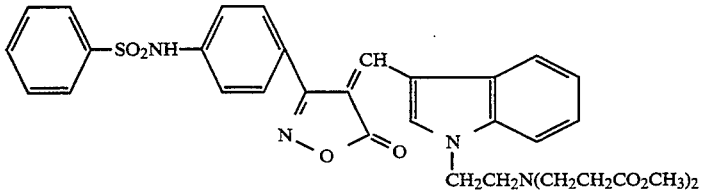
D-162
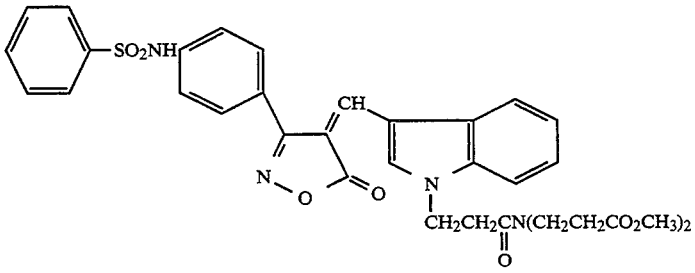
D-163
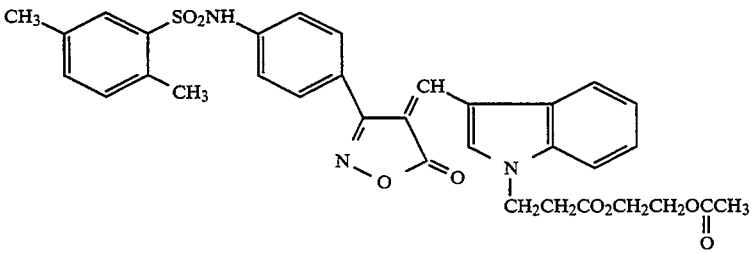
D-164
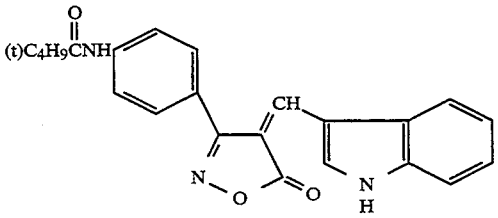
D-165
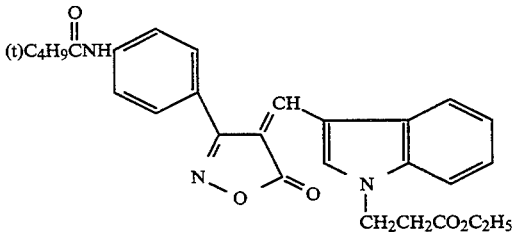
D-166
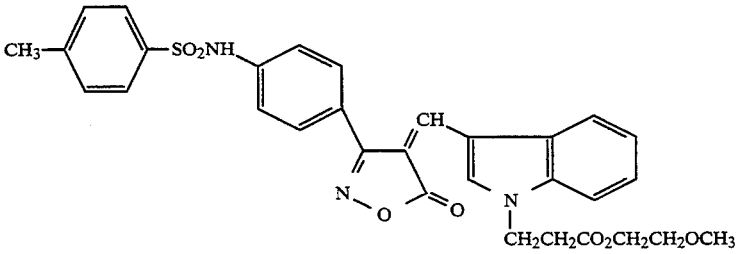

-continued
D-201
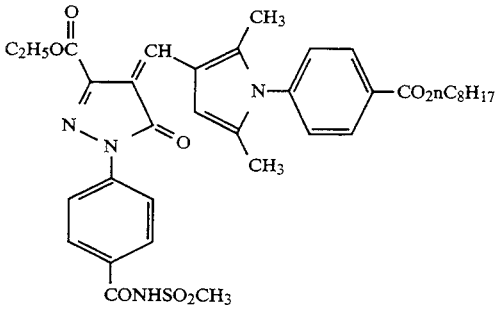
D-202
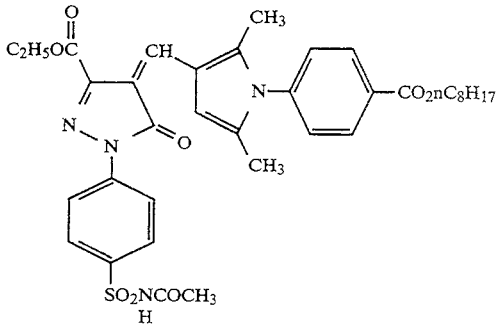
D-203
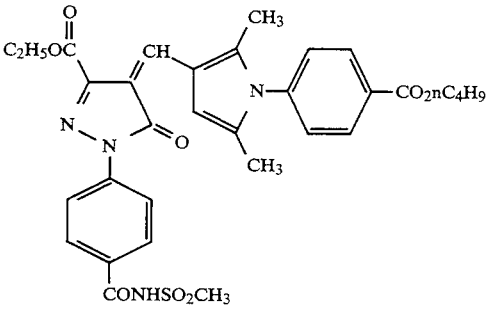
D-204
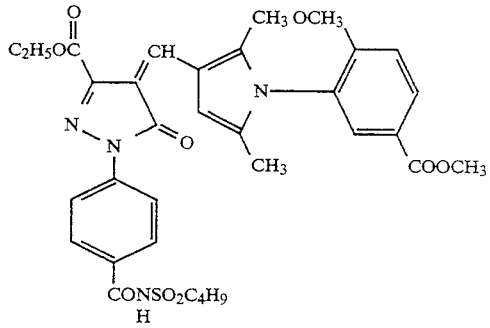
D-205
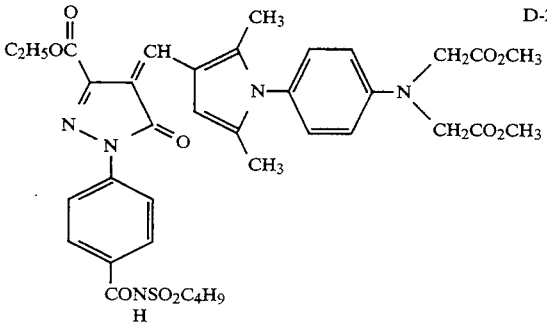
D-206
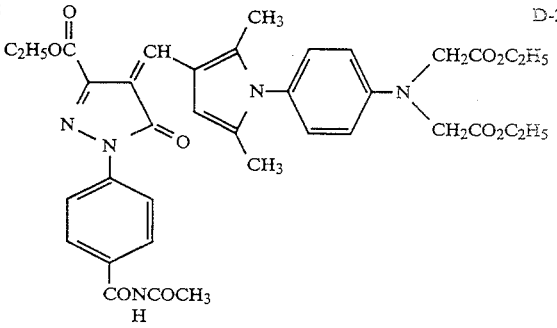
D-207
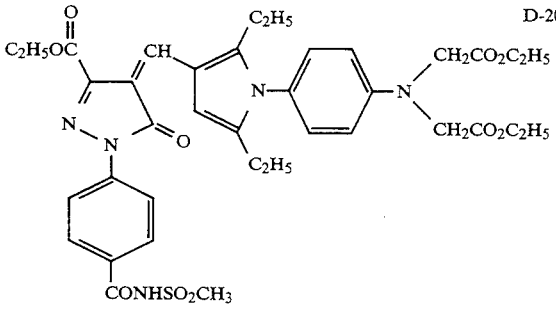
D-208
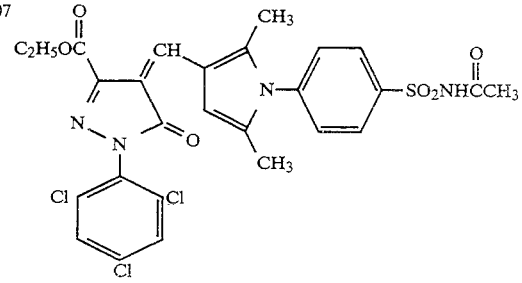
D-209
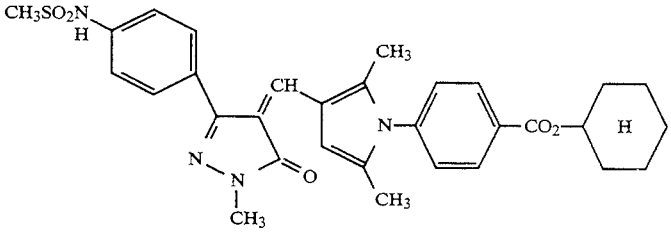

-continued
D-210
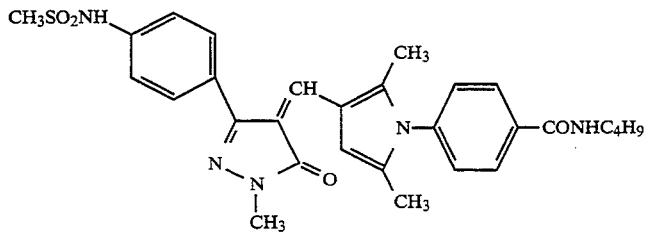
D-211
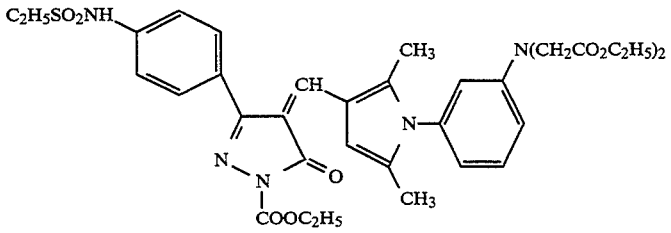
D-212
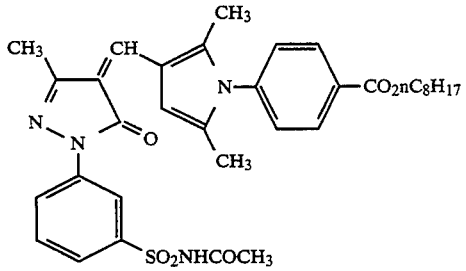
D-213
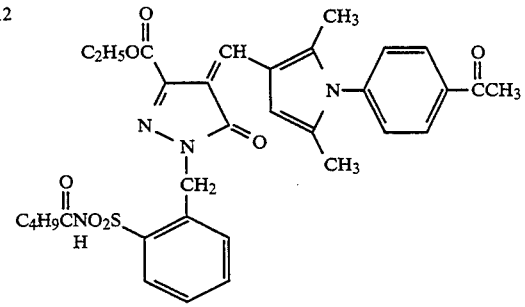
D-214
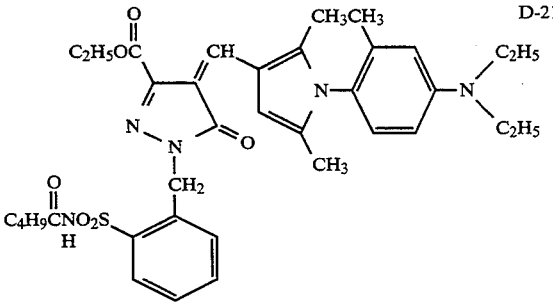
D-215
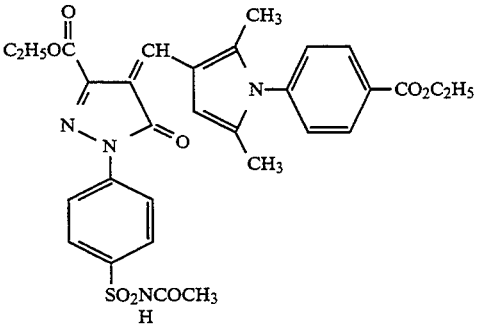
D-216
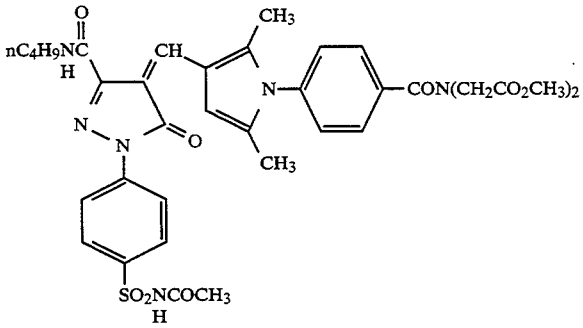

-continued
D-217
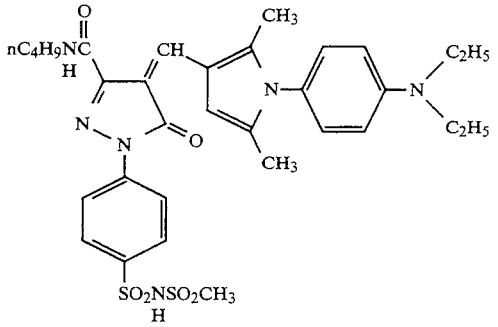
D-218
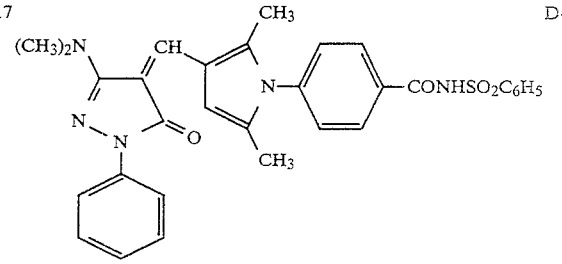
D-219
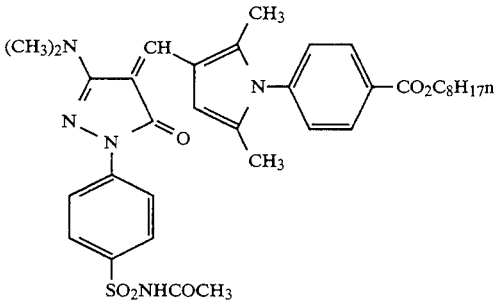
D-220
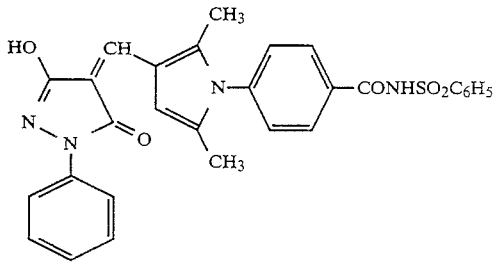
D-221
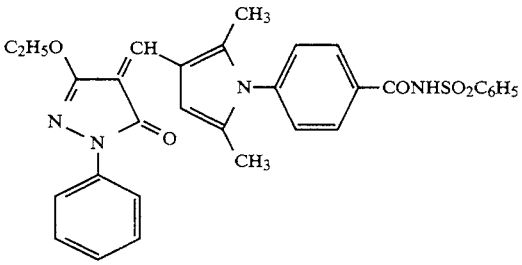
D-222
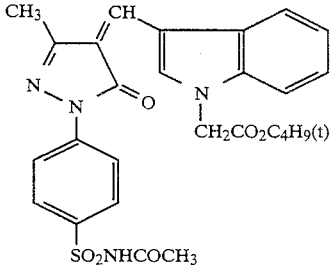
D-233
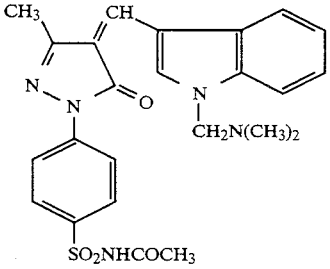
D-224
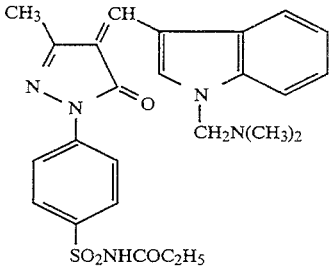
D-255
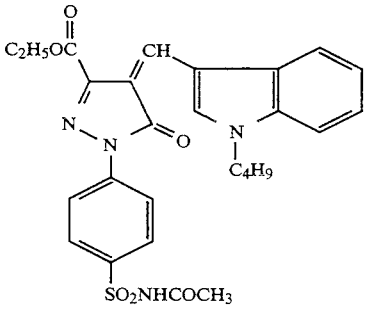
D-226
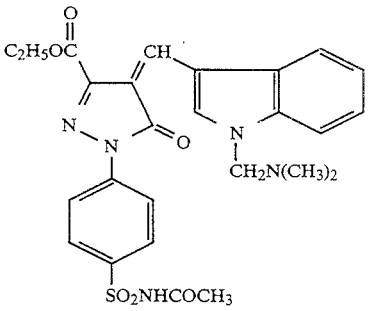

-continued
D-227
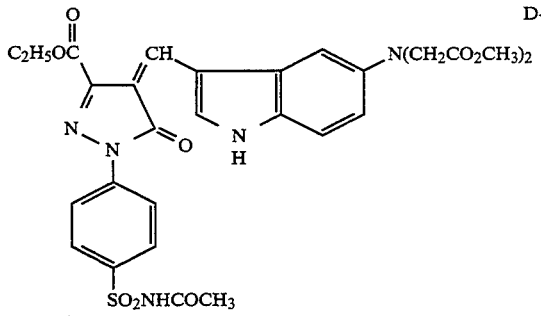
D-228
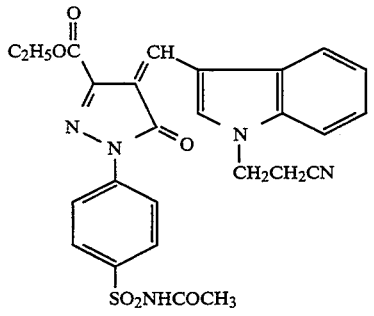
D-229
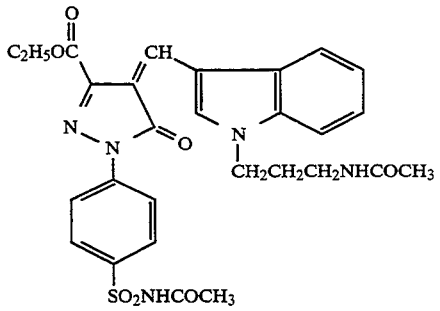
D-230
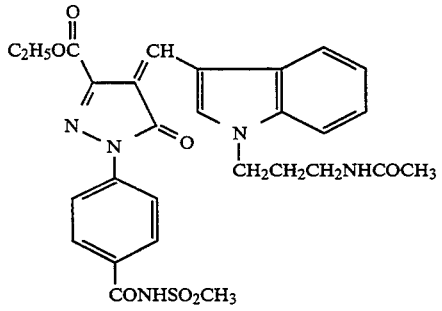
D-231
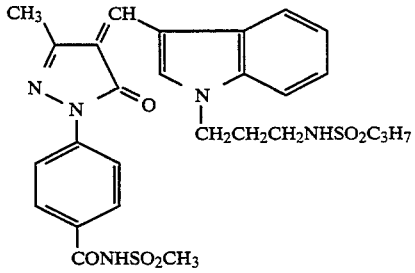
D-232
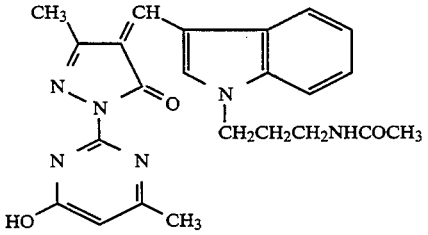
D-233
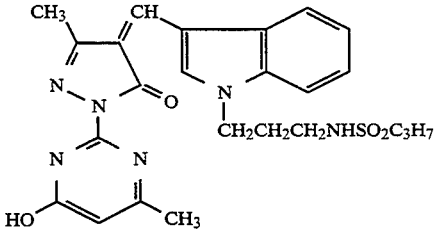
D-234
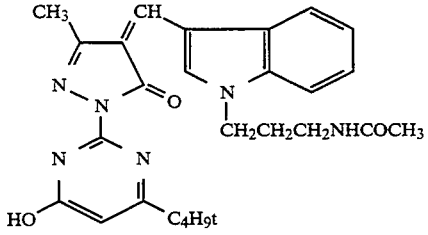
D-235
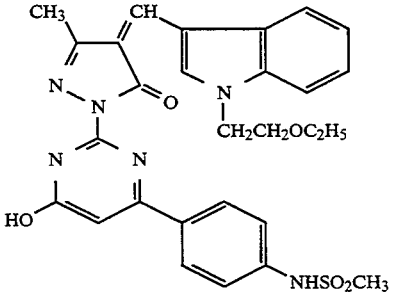
D-236
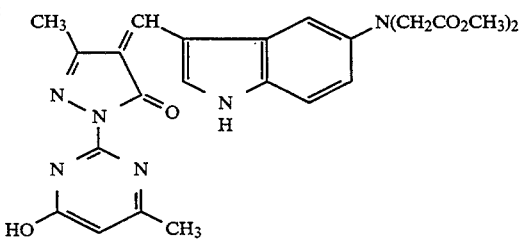

-continued

D-237

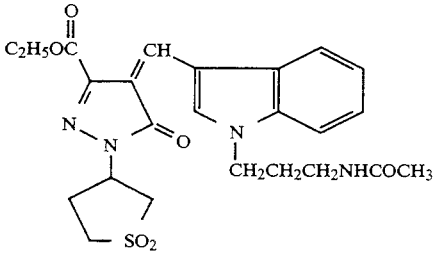

D-238

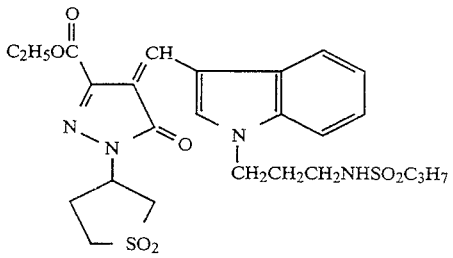

D-239

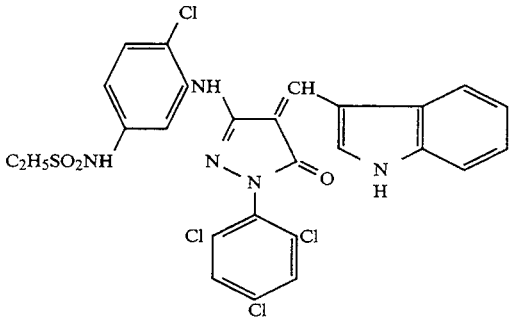

D-240

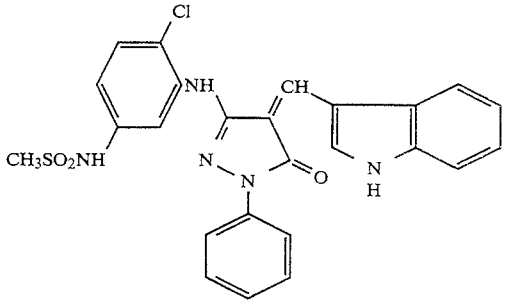

D-241

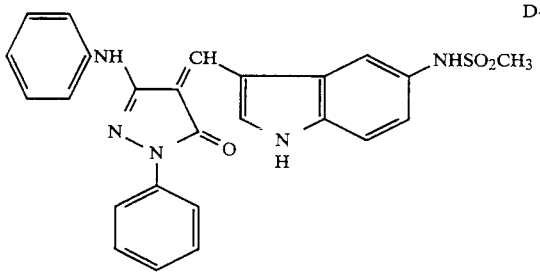

D-242

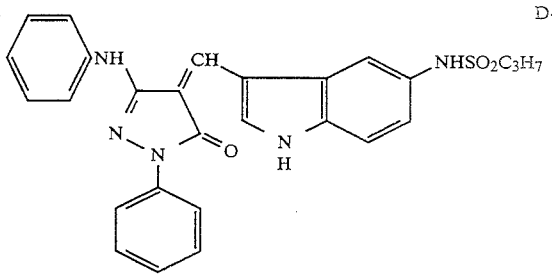

D-243

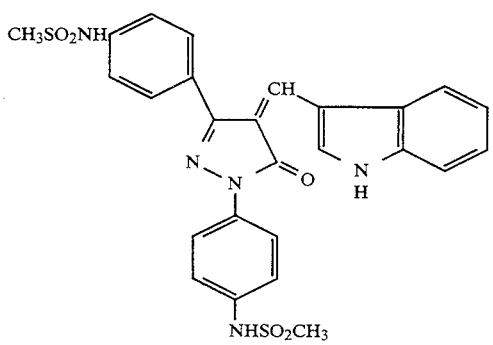

D-244

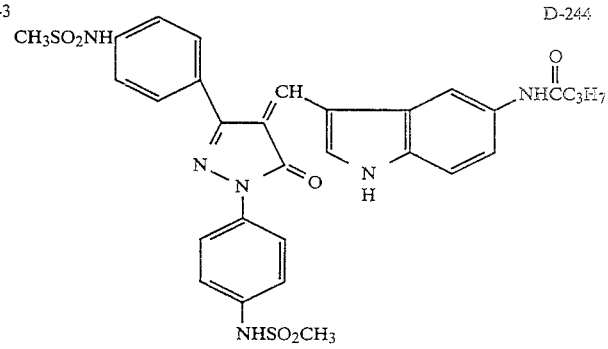

D-245

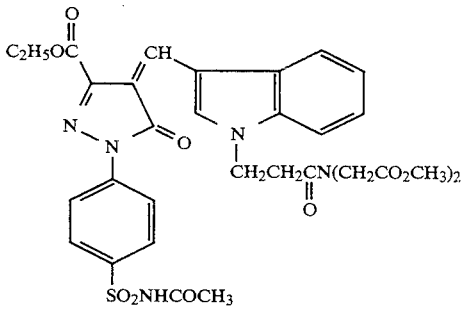

D-246

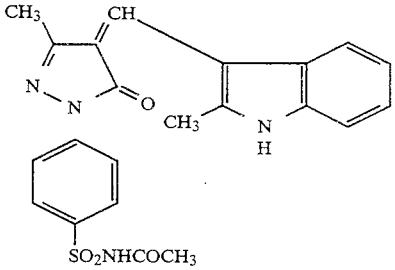

The above-mentioned compounds represented by Formula (I) can be synthesized by the method described in JP-A-4-348342.

The second characteristic feature of the light-sensitive material of the present invention is that, in order to improve color reproduction, at least one red-sensitive silver halide emulsion layer for forming a cyan color undergoes inhibition caused by the interlayer effect of a donor layer which is spectrally sensitized with a sensitizing dye represented by Formula (II) or (III) below.

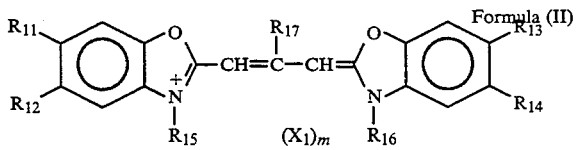

In this Formula (II), $R_{11}$, $R_{12}$, $R_{13}$, and $R_{14}$ may be the same or different and each represents a hydrogen atom, a halogen atom, alkyl, aryl, alkoxy, aryloxy, aryloxycarbonyl, alkoxycarbonyl, amino, acyl, cyano, carbamoyl, sulfamoyl, carboxyl, or an acyloxy group.

$R_{11}$ and $R_{12}$ or $R_{13}$ and $R_{14}$ do not represent a hydrogen atom simultaneously.

$R_{15}$ and $R_{16}$ may be the same or different and each represent an alkyl group.

$R_{17}$ represents an alkyl having three or more carbon atoms, aryl, or aralkyl group.

Alkyl, aryl, alkoxy, aryloxy, aryloxycarbonyl, alkoxycarbonyl, amino, acyl, carbamoyl, solfamoyl, aralkyl, or acyloxy group described above include the group having a substituent.

$X_1$ represents a counter anion, and m is an integer of 0 or 1, and m=0 when intramolecular salt is to be formed.

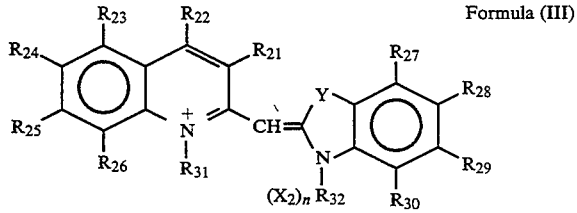

In this Formula (III), $R_{21}$, $R_{22}$, $R_{23}$, $R_{24}$, $R_{25}$, $R_{26}$, $R_{27}$, $R_{28}$, $R_{29}$, and $R_{30}$ each have the same meaning as that of $R_{11}$, $R_{31}$ and $R_{32}$ each have the same meaning as that of $R_{15}$.

Y represents a sulfur atom, a selenium atom, or an oxygen atom, $X_2$ has the same meaning as that of $X_1$, and n has the same meaning as that of m.

Preferable examples of substituents in a compound represented by Formula (II) used in the present invention are shown below. That is, preferable examples of $R_{11}$, $R_{12}$, $R_{13}$, and $R_{14}$ are an alkyl group {e.g., methyl, ethyl, propyl, isopropyl, butyl, branched butyl (e.g., isobutyl and tert-butyl), pentyl, branched pentyl (e.g., isopentyl and tert-pentyl), vinylmethyl, and cyclohexyl} with 10 or less carbon atoms, an aryl group (e.g., phenyl, 4-methylphenyl, 4-chlorophenyl, and naphthyl) with 10 or less carbon atoms, an aralkyl group (e.g., benzyl, phenethyl, and 3-phenylpropyl) with 10 or less carbon atoms, an alkoxy group (e.g., methoxy, ethoxy, propyloxy, butyloxy, pentyloxy, benzyloxy, and phenethyloxy) with 10 or less carbon atoms, an aryloxy (e.g., phenoxy, 4-methylphenoxy, 4-chlorophenoxy, and naphthyloxy) with 10 or less carbon atoms, a halogen atom (e.g., fluorine, chlorine, bromine, and iodine), a haloalkyl group (e.g., trifluoromethyl), an alkoxycarbonyl group (e.g., methoxycarbonyl, ethoxycarbonyl, and benzyloxycarbonyl) with 10 or less carbon atoms, an aryloxycarbonyl group (e.g., phenyloxycarbonyl, 4-methylphenylcarbonyl, 4-chlorophenyloxycarbonyl, and naphthyloxycarbonyl) with 10 or less carbon atoms, an acylamino group (e.g., acetylamino, propionylamino, and benzoylamino) with 8 or less carbon atoms, an acyl group (e.g., acetyl, propionyl, benzoyl, and mesyl) with 10 or less carbon atoms, cyano, a carbamoyl group (e.g., carbamoyl, N,N-dimethylcarbamoyl, and morpholinocarbamoyl) with 6 or less carbon atoms, a carboxyl group, and an acyloxy group (acetyloxy, propionyloxy, and benzoyloxy) with 10 or less carbon atoms. In a compound represented by Formula (II), it is most preferred that $R_{11}$ and $R_{13}$ be hydrogen atoms, $R_{12}$ be chlorine or a phenyl group, and R14 be chlorine or a phenyl group.

Examples of $R_{15}$ and $R_{16}$ are an alkyl group (e.g., methyl, ethyl, propyl, vinylmethyl, butyl, pentyl, hexyl, heptyl, and octyl) with 8 or less carbon atoms and an aralkyl group (e.g., benzyl, phenethyl, and 3-phenylpropyl) with 10 or less carbon atoms. Examples of the substituents of $R_{15}$ and $R_{16}$ are hydroxyl, carboxyl, sulfo, cyano, a halogen atom (e.g., fluorine, chlorine, and bromine), an alkoxycarbonyl group (e.g., methoxycarbonyl, ethoxycarbonyl, and benzyloxycarbonyl) with 8 or less carbon atoms, an alkoxy group (e.g., methoxy, ethoxy, butyloxy, benzyloxy, and phenethyloxy) with 8 or less carbon atoms, an aryloxy group (e.g., phenoxy and p-tolyloxy) with 8 or less carbon atoms, an acyloxy group (e.g., acetyloxy, propionyloxy, and benzoyloxy) with 8 or less carbon atoms, an acyl group (e.g., acetyl, propionyl, benzoyl, and 4-fluorobenzoyl) with 8 or less carbon atoms, a carbamoyl group (e.g., carbamoyl, N,N-dimethylcarbamoyl, morpholinocarbonyl, piperidinocarbonyl, and methanesulfonylaminocarbonyl) with 6 or less carbon atoms, a sulfamoyl group (e.g., sulfamoyl, N,N-dimethylsulfamoyl, morpholinosulfonyl, piperidinosulfonyl, and acetylaminosulfonyl) with 6 or less carbon atoms, and an aryl group (e.g., phenyl, p-fluorophenyl, p-hydroxyphenyl, p-carboxyphenyl, and p-sulfophenyl) with 10 or less carbon atoms.

$R_{15}$ and $R_{16}$ are more preferably sulfoethyl, sulfopropyl, sulfobutyl, 1-methylsulfopropyl, carboxymethyl, and carboxyethyl, and most preferably sulfopropyl and sulfobutyl.

Preferable examples of $R_{17}$ are an alkyl group (e.g., propyl, isopropyl, cyclopropyl, butyl, a branched butyl group (e.g., isobutyl and tert-butyl), pentyl, branched pentyl (e.g., isopentyl and tert-pentyl), and cyclohexyl) with 3 to 8 carbon atoms, an aryl group (e.g., phenyl and p-tolyl) with 10 or less carbon atoms, and an aralkyl group (e.g., benzyl, phenethyl, and 3-phenylpropyl) with 10 or less carbon atoms.

$R_{17}$ is preferably an alkyl group (including substituted alkyl) or an aryl group (including substituted aryl) each having L, $B_1$, $B_2$, $B_3$, and $B_4$ which satisfy relations $L>4.11$, $B_1>1.52$, $B_2>1.90$, $B_3>1.90$, and $B_4>2.97$. These L, $B_1$, $B_2$, $B_3$, and $B_4$ represent the values (unit=Å) of L, $B_1$, $B_2$, $B_3$, and $B_4$ of STERIMOL parameters described in, e.g., A. Verloop, W. Hoogenstraaten, and J. Tipker, "Drug Design, Vol. VII" (E. J. Ariens ed.), Academic Press, New York (1976), pp. 180 to 185.

Practical examples of $R_{17}$ are propyl, isopropyl, cyclopropyl, butyl, isobutyl, chloromethyl, 2-chloroethyl, 3-chloropropyl, phenyl, and benzyl. $R_{17}$ is most preferably propyl, phenyl, or benzyl.

In Formula (III), $R_{21}$, $R_{22}$, $R_{23}$, $R_{24}$, $R_{25}$, $R_{26}$, $R_{27}$, $R_{28}$, $R_{29}$, and $R_{30}$ have the same meaning as that of $R_{11}$, and $R_{31}$ and $R_{32}$ have the same meaning as that of $R_{15}$. Y represents a sulfur atom, a selenium atom, or an oxygen atom. $X_2$ has the same meaning as that of $X_1$, and n has the same meaning as that of m.

The above-mentioned compounds represented by Formulas (II) and (III) used in the present invention can be synthesized by the methods described in, e.g., F. M. Hamer, "Heterocyclic Compounds - Cyanine Dyes and Related Compounds," John Wiley & Sons, New York, London, 1964; D. M. Sturmer, "Heterocyclic Compounds -Special topics in heterocyclic chemistry-," Chapter 18, Paragraph 14, pages 482 to 515, John Wiley & Sons, New York, London, 1977; and "Rodd's Chemistry of Carbon Compounds," 2nd ed., Vol. IV, part B, 1977, Chapter 15, pages 369 to 422 and 2nd ed., part B, 1985, Chapter 15, pages 267 to 296, Elsvier Science Publishing Company Inc., New York.

Practical examples of compounds represented by Formulas (II) and (III) of the present invention are presented below, but the invention is not limited to these examples.

I-1

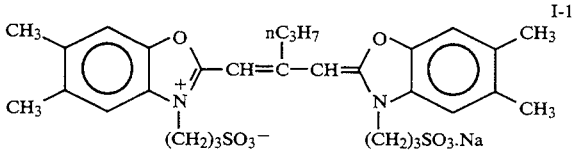

I-2

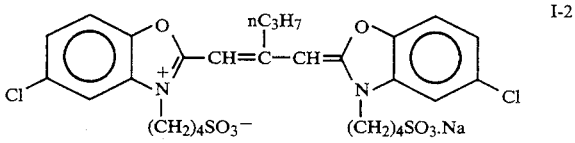

I-3

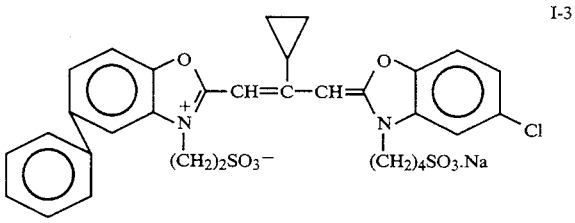

I-4

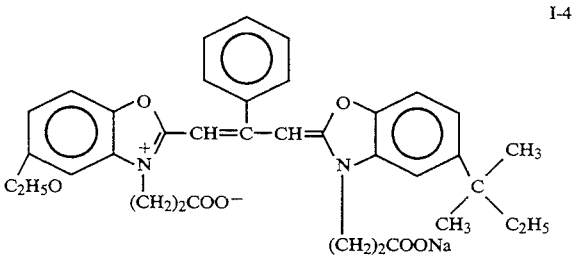

I-5

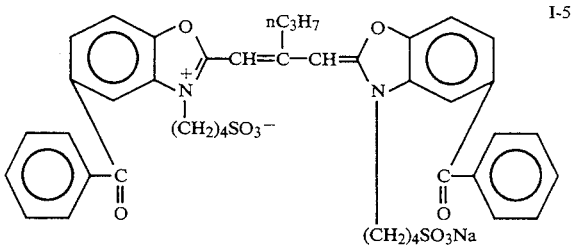

-continued

I-6

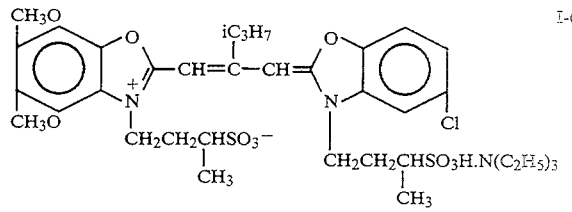

I-7

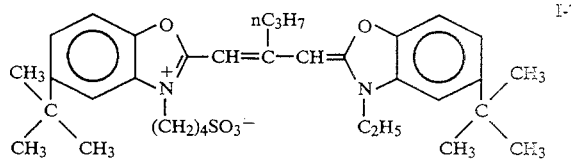

I-8

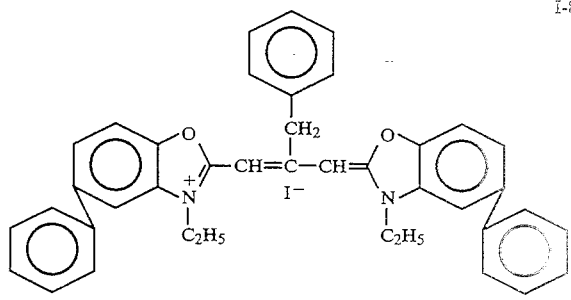

I-9

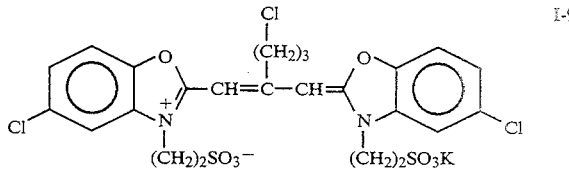

I-10

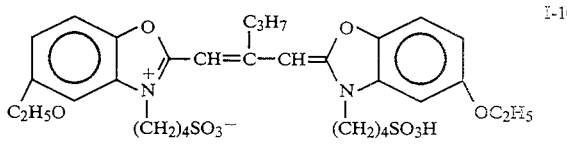

I-11

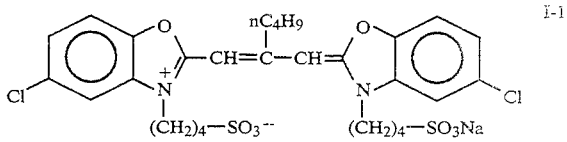

II-1

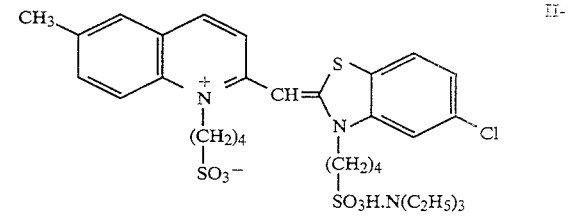

II-2

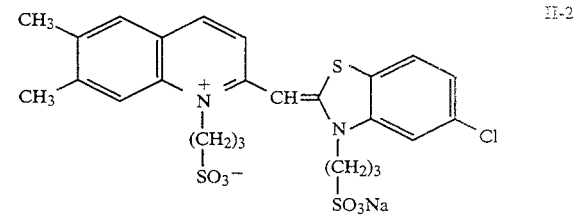

-continued

II-3

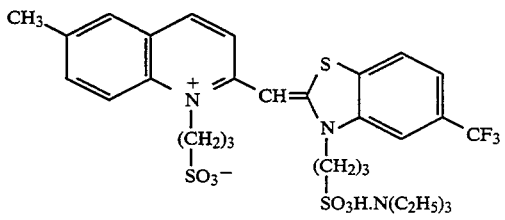

II-4

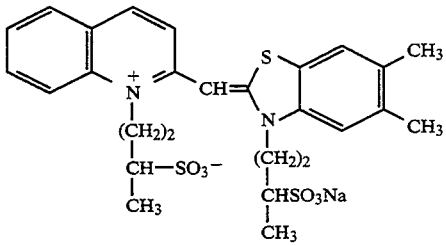

II-5

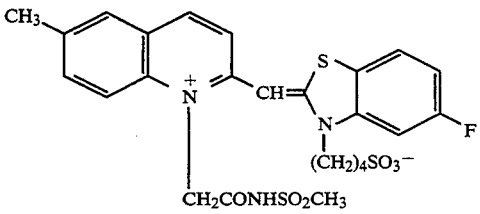

II-6

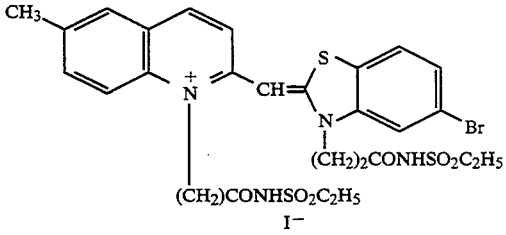

II-7

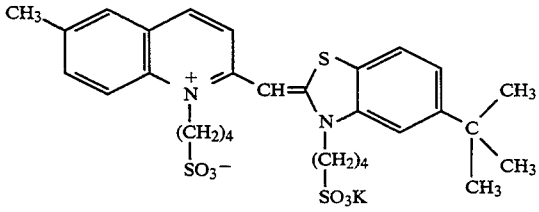

II-8

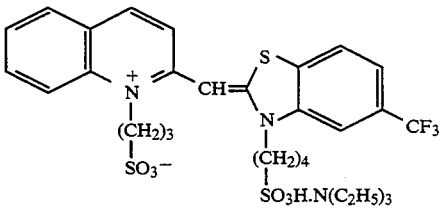

II-9

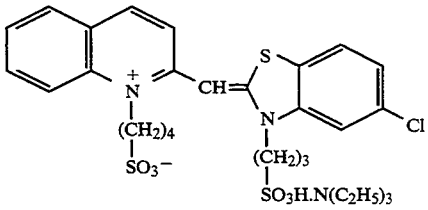

-continued

II-10

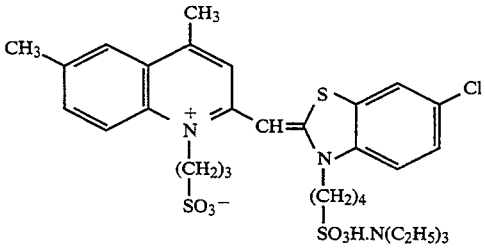

II-11

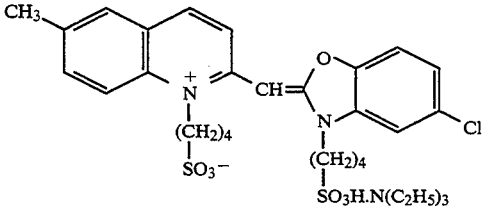

II-12

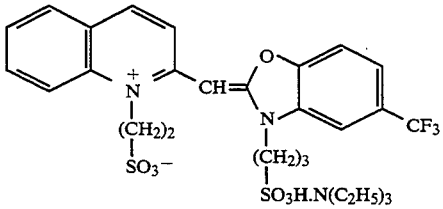

The use amount of the sensitizing dye represented by Formula (II) or (III) above is 20% or more of the amount of dyes used in the donor layer with the interlayer effect. The actual addition amount of the sensitizing dye is preferably $4\times10^{-6}$ to $8\times10^{-3}$ mol, and more preferably $1\times10^{-5}$ to $2\times10^{-3}$ mol per mol of a silver halide. This sensitizing dye can be added at any stage, which has been conventionally known to be useful, during preparation of an emulsion.

Although the above sensitizing dye can be used either singly or in combination with any other dye, it is more preferred to use it together with a cyanine-based dye.

In the light-sensitive material of the present invention, the donor layer with the interlayer effect, which is spectrally sensitized with the sensitizing dye represented by Formula (II) or (III) above, can be arranged at any position provided that the layer is nearer to a support than the hydrophilic layer containing a compound represented by Formula (I).

A preferable silver halide contained in photographic emulsion layers of the photographic light-sensitive material of the present invention is silver bromoiodide, silver iodochloride, or silver bromochloroiodide each containing about 30 mol % or less of silver iodide. The silver halide is most preferably silver bromoiodide or silver bromochloroiodide each containing about 2 mol % to about 10 mol % of silver iodide.

Silver halide grains contained in the photographic emulsion may have regular crystals, such as cubic, octahedral, or tetradecahedral crystals, or irregular crystals, such as spherical or tabular crystals. The silver halide grains can also have crystal defects, such as twin planes, or may take composite shapes of these shapes.

The silver halide may consist of fine grains having a grain size of about 0.2 μm or less or large grains having a projected area diameter of about 10 μm, and the emulsion may be either a polydisperse or monodisperse emulsion.

Silver halide photographic emulsions which can be used in the light-sensitive material of the present invention can be prepared by the methods described in, for example, "I. Emulsion preparation and types," Research Disclosure (RD) No. 17643 (December, 1978), pp. 22 and 23, RD No. 18716 (November, 1979), page 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, for example, U.S. Pat. Nos. 3,574,628 and 3,655,394 and British Patent 1,413,748 are also preferred.

Also, tabular grains having an aspect ratio of about 3 or more can be used in the present invention. The tabular grains can be easily prepared by methods described in, e.g., Gutoff, "Photographic Science and Engineering", Vol. 14, pp. 248 to 257 (1970); U.S. Pat. Nos. 4,434,226, 4,414,310, 4,433,048, and 4,439,520, and British Patent 2,112,157.

A crystal structure may be uniform, may have different halogen compositions in the internal and the external layer thereof, or may be a layered structure. Alternatively, a silver halide may be bonded to another silver halide having a different composition via an epitaxial junction or to a compound except for a silver halide, such as silver rhodanide or zinc oxide. A mixture of grains having various types of crystal shapes may also be used.

The above emulsion may be any of a surface latent image type emulsion which mainly forms a latent image on the surface of a grain, an internal latent image type emulsion which forms a latent image in the interior of a grain, and an emulsion of another type which has latent images both on the surface and in the interior of a grain. However, the emulsion must be a negative type emulsion. In this case, the internal latent image type emulsion may be a core/shell internal latent image type emulsion described in JP-A-63-264740. A method of preparing this core/shell internal latent image type emulsion is described in JP-A-59-133542. Although the thickness of a shell of this emulsion depends on, e.g., development conditions, it is preferably 3 to 40 nm, and most preferably 5 to 20 nm.

A silver halide emulsion is normally subjected to physical ripening, chemical ripening, and spectral sensitization steps before being used. The kinds of additives for use in these steps are described in Research Disclosure Nos. 17643, 18716, and 307105, and the kinds of additive and the relevant part in the publications are summarized in the following table.

TABLE

| No. | Kinds of additives | RD17643 [Dec. 1978] | RD18716 [Nov. 1979] | RD307105 [Nov. 1989] |
|---|---|---|---|---|
| 1. | Chemical sensitizers | page 23 | page 648, right column | page 866 |
| 2. | Sensitivity intensifiers | | page 648, right column | |
| 3. | Spectral sensitizers, Super sensitizers | pages 23–24 | From page 648, right column to page 649, right column | pages 866 to 868 |
| 4. | Brighteners | page 24 | page 647, right column | page 868 |
| 5. | Antifoggants, Stabilizers | pages 24–25 | page 649, right column | pages 868 to 870 |
| 6. | Light absorbent, Filter dye, Ultraviolet absorbents | pages 25–26 | From page 649, right column to page 650, left column | page 873 |
| 7. | Stain-inhibitors | page 25, right column | page 650, left to right columns | page 872 |
| 8. | Dye image stabilizers | page 25 | page 650, left column | page 872 |
| 9. | Hardeners | page 26 | page 651, left column | pages 874 to 875 |
| 10. | Binders | " | page 651, left column | pages 873 to 874 |
| 11. | Plasticizers, Lubricants | page 27 | page 650, right column | page 876 |
| 12. | Coating auxiliaries, Surfactants | pages 26–27 | page 650, right column | pages 875 to 876 |
| 13. | Anti-static agents | page 27 | page 650, right column | pages 876 to 877 |
| 14. | Matting agents | | | pages 878 to 879 |

The silver halide light-sensitive material of the present invention can achieve its effect more easily when applied to a lens-incorporating film unit, such as those described in JP-B-2-32615 ("JP-B" means Published Examined Japanese Patent Application) and Published Examined Japanese Utility Model Application No. 3-39784.

EXAMPLES

The present invention will now be described in greater detail by reference to the following examples. These examples, however, are not intended to be interpreted as limiting the scope of the present invention.

Example 1

Layers having the following compositions were formed on a subbed triacetylcellulose film support to make a sample 101 as a multilayered color light-sensitive material.

Compositions of Light-Sensitive Layers

The coating amount of each of a silver halide and colloidal silver is represented by a silver amount in units of g/m$^2$, and that of each of a coupler, an additive, and gelatin is represented in units of g/m$^2$. The coating amount of a sensitizing dye is represented by the number of mols per mol of a silver halide in the same layer. Note that symbols representing additives have the following meanings. Note also that when an additive has a plurality of effects, a representative one of the effects is shown.

UV; ultraviolet absorbent, Solv; high-boiling organic solvent, ExF; dye, ExS; sensitizing dye, ExC; cyan coupler, ExM; magenta coupler, ExY; yellow coupler, Cpd; additive.

| | |
|---|---|
| 1st layer (Antihalation layer) | |
| Black colloidal silver silver | 0.15 |
| Gelatin | 2.33 |
| UV-1 | $3.0 \times 10^{-2}$ |
| UV-2 | $6.0 \times 10^{-2}$ |
| UV-3 | $7.0 \times 10^{-2}$ |
| ExF-1 | $1.0 \times 10^{-2}$ |
| ExF-2 | $4.0 \times 10^{-2}$ |
| ExF-3 | $5.0 \times 10^{-3}$ |
| ExM-3 | 0.11 |
| Cpd-5 | $1.0 \times 10^{-3}$ |
| Solv-1 | 0.16 |
| Solv-2 | 0.10 |
| 2nd layer (Low-speed red-sensitive emulsion layer) | |
| Silver bromoiodide emulsion A silver | 0.35 |
| Silver bromoiodide emulsion B silver | 0.18 |
| Gelatin | 0.77 |
| ExS-1 | $2.4 \times 10^{-4}$ |
| ExS-2 | $1.4 \times 10^{-4}$ |
| ExS-5 | $2.3 \times 10^{-4}$ |
| ExS-7 | $4.1 \times 10^{-6}$ |
| ExC-1 | $9.0 \times 10^{-2}$ |
| ExC-2 | $5.0 \times 10^{-3}$ |
| ExC-3 | $4.0 \times 10^{-2}$ |
| ExC-5 | $8.0 \times 10^{-2}$ |
| ExC-6 | $2.0 \times 10^{-2}$ |
| ExC-9 | $2.5 \times 10^{-2}$ |
| Cpd-4 | $2.2 \times 10^{-2}$ |
| 3rd layer (Medium-speed red-sensitive emulsion layer) | |
| Silver bromoiodide emulsion C silver | 0.55 |
| Gelatin | 1.46 |
| ExS-1 | $2.4 \times 10^{-4}$ |
| ExS-2 | $1.4 \times 10^{-4}$ |
| ExS-5 | $2.4 \times 10^{-4}$ |
| ExS-7 | $4.3 \times 10^{-6}$ |
| ExC-1 | 0.19 |
| ExC-2 | $1.0 \times 10^{-2}$ |
| ExC-3 | $1.0 \times 10^{-2}$ |
| ExC-4 | $1.6 \times 10^{-2}$ |
| ExC-5 | 0.19 |
| ExC-6 | $2.0 \times 10^{-2}$ |
| ExC-7 | $2.5 \times 10^{-2}$ |
| ExC-9 | $3.0 \times 10^{-2}$ |
| Cpd-4 | $1.5 \times 10^{-2}$ |
| 4th layer (High-speed red-sensitive emulsion layer) | |
| Silver bromoiodide emulsion D silver | 1.05 |
| Gelatin | 1.38 |
| ExS-1 | $2.0 \times 10^{-4}$ |
| ExS-2 | $1.1 \times 10^{-4}$ |
| ExS-5 | $1.9 \times 10^{-4}$ |
| ExS-7 | $1.4 \times 10^{-5}$ |
| ExC-1 | $2.0 \times 10^{-2}$ |
| ExC-3 | $2.0 \times 10^{-2}$ |
| ExC-4 | $9.0 \times 10^{-2}$ |
| ExC-5 | $5.0 \times 10^{-2}$ |
| ExC-8 | $1.0 \times 10^{-2}$ |
| ExC-9 | $1.0 \times 10^{-2}$ |
| Cpd-4 | $1.0 \times 10^{-3}$ |
| Solv-1 | 0.70 |
| Solv-2 | 0.15 |
| 5th layer (Interlayer) | |

-continued

| | |
|---|---|
| Gelatin | 0.62 |
| Cpd-1 | 0.13 |
| Polyethylacrylate latex | $8.0 \times 10^{-2}$ |
| Solv-1 | $8.0 \times 10^{-2}$ |
| 6th layer (Low-speed green-sensitive emulsion layer) | |
| Silver bromoiodide emulsion E silver | 0.10 |
| Silver bromoiodide emulsion F silver | 0.28 |
| Gelatin | 0.31 |
| ExS-3 | $1.0 \times 10^{-4}$ |
| ExS-4 | $3.1 \times 10^{-4}$ |
| ExS-5 | $6.4 \times 10^{-5}$ |
| ExM-1 | 0.12 |
| ExM-7 | $2.1 \times 10^{-2}$ |
| Solv-1 | 0.09 |
| Solv-3 | $7.0 \times 10^{-3}$ |
| 7th layer (Medium-speed green-sensitive emulsion layer) | |
| Silver bromoiodide emulsion G silver | 0.37 |
| Gelatin | 0.54 |
| ExS-3 | $2.7 \times 10^{-4}$ |
| ExS-4 | $8.2 \times 10^{-4}$ |
| ExS-5 | $1.7 \times 10^{-4}$ |
| ExM-1 | 0.27 |
| ExM-7 | $7.2 \times 10^{-2}$ |
| ExY-1 | $5.4 \times 10^{-2}$ |
| Solv-1 | 0.23 |
| Solv-3 | $1.8 \times 10^{-2}$ |
| 8th layer (High-speed green-sensitive emulsion layer) | |
| Silver bromoiodide emulsion H silver | 0.53 |
| Gelatin | 0.61 |
| ExS-4 | $4.3 \times 10^{-4}$ |
| ExS-5 | $8.6 \times 10^{-5}$ |
| ExS-8 | $2.8 \times 10^{-5}$ |
| ExM-2 | $5.5 \times 10^{-3}$ |
| ExM-3 | $1.0 \times 10^{-2}$ |
| ExM-5 | $1.0 \times 10^{-2}$ |
| ExM-6 | $3.0 \times 10^{-2}$ |
| ExY-1 | $1.0 \times 10^{-2}$ |
| ExC-1 | $4.0 \times 10^{-3}$ |
| ExC-4 | $2.5 \times 10^{-3}$ |
| Cpd-6 | $1.0 \times 10^{-2}$ |
| Solv-1 | 0.12 |
| 9th layer (Interlayer) | |
| Gelatin | 0.56 |
| UV-4 | $4.0 \times 10^{-2}$ |
| UV-5 | $3.0 \times 10^{-2}$ |
| Cpd-1 | $4.0 \times 10^{-2}$ |
| Polyethylacrylate latex | $5.0 \times 10^{-2}$ |
| Solv-1 | $3.0 \times 10^{-2}$ |
| 10th layer (Donor layer having interlayer effect on red-sensitive layer) | |
| Silver bromoiodide emulsion I silver | 0.40 |
| Silver bromoiodide emulsion J silver | 0.20 |
| Silver bromoiodide emulsion K silver | 0.39 |
| Gelatin | 0.87 |
| ExS-3 | $6.7 \times 10^{-4}$ |
| ExM-2 | 0.16 |
| ExM-4 | $3.0 \times 10^{-2}$ |
| ExM-5 | $5.0 \times 10^{-2}$ |
| ExY-2 | $2.5 \times 10^{-3}$ |
| ExY-5 | $2.0 \times 10^{-2}$ |
| Solv-1 | 0.30 |
| Solv-5 | $3.0 \times 10^{-2}$ |
| 11th layer (Yellow filter layer) | |
| Yellow colloidal silver silver | $9.0 \times 10^{-2}$ |
| Gelatin | 0.84 |
| Cpd-1 | $5.0 \times 10^{-2}$ |
| Cpd-2 | $5.0 \times 10^{-2}$ |
| Cpd-5 | $2.0 \times 10^{-3}$ |
| Solv-1 | 0.13 |
| H-1 | 0.25 |
| 12th layer (Low-speed blue-sensitive emulsion layer) | |

-continued

| | |
|---|---|
| Silver bromoiodide emulsion L silver | 0.50 |
| Silver bromoiodide emulsion M silver | 0.40 |
| Gelatin | 1.75 |
| ExS-6 | $9.0 \times 10^{-4}$ |
| ExY-1 | $8.5 \times 10^{-2}$ |
| ExY-2 | $5.5 \times 10^{-3}$ |
| ExY-3 | $6.0 \times 10^{-2}$ |
| ExY-5 | 1.00 |
| ExC-1 | $5.0 \times 10^{-2}$ |
| ExC-2 | $8.0 \times 10^{-2}$ |
| Solv-1 | 0.54 |
| 13th layer (Interlayer) | |
| Gelatin | 0.30 |
| ExY-4 | 0.14 |
| Solv-1 | 0.14 |
| 14th layer (High-speed blue-sensitive emulsion layer) | |
| Silver bromoiodide emulsion N silver | 0.40 |
| Gelatin | 0.95 |
| ExS-6 | $2.6 \times 10^{-4}$ |
| ExY-2 | $1.0 \times 10^{-2}$ |
| ExY-3 | $2.0 \times 10^{-2}$ |
| ExY-5 | 0.18 |
| ExC-1 | $1.0 \times 10^{-2}$ |
| Solv-1 | $9.0 \times 10^{-2}$ |
| 15th layer (1st protective layer) | |
| Fine grain silver bromoiodide emulsion O silver | 0.12 |
| Gelatin | 0.63 |

-continued

| | |
|---|---|
| UV-4 | 0.11 |
| UV-5 | 0.18 |
| Cpd-3 | 0.10 |
| Solv-4 | $2.0 \times 10^{-2}$ |
| Polyethylacrylate latex | $9.0 \times 10^{-2}$ |
| 16th layer (2nd protective layer) | |
| Fine grain silver bromoiodide emulsion O silver | 0.36 |
| Gelatin | 0.85 |
| B-1 (diameter 2.0 μm) | $8.0 \times 10^{-2}$ |
| B-2 (diameter 2.0 μm) | $8.0 \times 10^{-2}$ |
| B-3 | $2.0 \times 10^{-2}$ |
| W-5 | $2.0 \times 10^{-2}$ |
| H-1 | 0.18 |

In addition to the above components, the sample thus manufactured was added with 1,2-benzisothiazolin-3-one (200 ppm on average with respect to gelatin), n-butyl-p-hydroxybenzoate (about 1,000 ppm on average with respect to gelatin), and 2-phenoxyethanol (about 10,000 ppm on average with respect to gelatin). In order to improve shelf stability, processability, a resistance to pressure, antiseptic and mildewproofing properties, antistatic properties, and coating properties, the individual layers were further added with W-1 to W-6, B-1 to B-6, F-1 to F-16, iron salt, lead salt, gold salt, platinum salt, iridium salt, and rhodium salt.

The emulsions represented by the abbreviations described above are shown in Table 1 below.

TABLE 1

| | Average AgI content (mole %) | Average grain size represented by equivalent-sphere diameter (μm) | Variation coefficient (%) of grain size distribution | Diameter/thickness ratio | Silver amount ratio [core/intermediate/shell] (AgI content) | Grain structure and grain shape |
|---|---|---|---|---|---|---|
| Emulsion A | 4.7 | 0.40 | 10 | 1.0 | [4/1/5] [1/38/1] | Triple structure cubic grain |
| B | 6.0 | 0.49 | 23 | 2.0 | [1/2] (16/1) | Double structure plate grain |
| C | 8.4 | 0.65 | 23 | 2.2 | [3/5/2] (0/14/7) | Triple structure plate grain |
| D | 8.8 | 0.65 | 15 | 3.5 | [12/59/29] (0/12/6) | Triple structure plate grain |
| E | 4.0 | 0.35 | 25 | 2.8 | — | Uniform structure plate grain |
| F | 4.0 | 0.50 | 18 | 4.0 | — | Uniform structure tabular grain |
| Emulsion G | 3.5 | 0.55 | 15 | 3.5 | [12/59/29] (0/5/2) | Triple structure tabular grain |
| H | 10.0 | 0.70 | 20 | 5.5 | [12/59/29] (0/13/8) | Triple structure tabular grain |
| I | 3.8 | 0.70 | 15 | 3.5 | [12/59/29] (0/5/3) | Triple structure tabular grain |
| J | 8.0 | 0.65 | 28 | 2.5 | [1/2] (18/3) | Double structure plate grain |
| K | 10.3 | 0.40 | 15 | 1.0 | [1/3] (29/4) | Double structure octahedral grain |
| Emulsion L | 9.0 | 0.66 | 19 | 5.8 | [8/59/33] (0/11/8) | Triple structure tabular grain |
| M | 2.5 | 0.46 | 30 | 7.0 | — | Uniform structure |

TABLE 1-continued

| | Average AgI content (mole %) | Average grain size represented by equivalent-sphere diameter (μm) | Variation coefficient (%) of grain size distribution | Diameter/thickness ratio | Silver amount ratio [core/intermediate/shell] (AgI content) | Grain structure and grain shape |
|---|---|---|---|---|---|---|
| | | | | | | tabular grain |
| N | 13.9 | 1.30 | 25 | 3.0 | [7/13] (34/3) | Double structure plate grain |
| O | 2.0 | 0.07 | 15 | 1.0 | — | Uniform structure fine grain |

In Table 1, (1) The emulsions A to N were subjected to reduction sensitization during grain preparation by using thiourea dioxide and thiosulfonic acid in accordance with the examples in JP-A-2-191938.

(2) The emulsions A to N were subjected to gold sensitization, sulfur sensitization, and selenium sensitization in the presence of the spectral sensitizing dyes described in the individual light-sensitive layers and sodium thiocyanate in accordance with the examples in JP-A-3-237450.

(3) The preparation of tabular grains was performed by using low-molecular weight gelatin in accordance with the examples in JP-A-1-158426.

(4) Dislocation lines as described in JP-A-3-237450 were observed in tabular grains and regular crystal grains having a grain structure when a high-voltage electron microscope was used.

(5) The emulsions A to N contained iridium in the interior of their grains through the use of the method described in B. H. Carroll, Photographic Science and Engineering, 24, 265 (1980).

The compounds used in the formation of the individual layers were as follows.

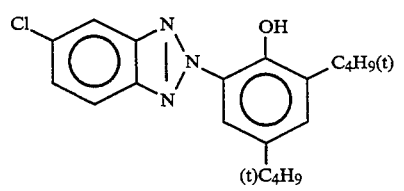

UV-1

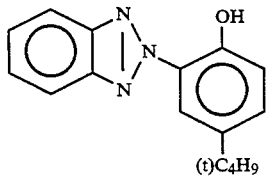

UV-2

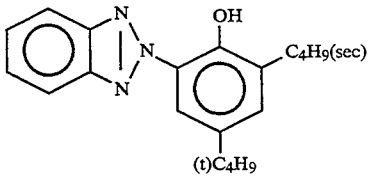

UV-3

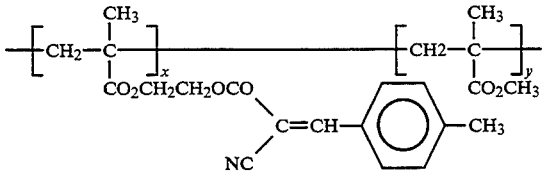

X:Y = 70:30 (wt %)

UV-4

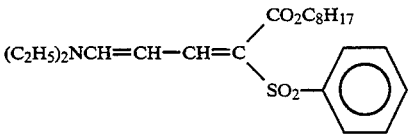

UV-5

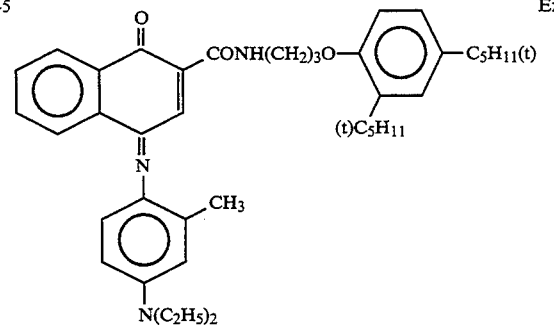

ExF-1

-continued
ExF-2
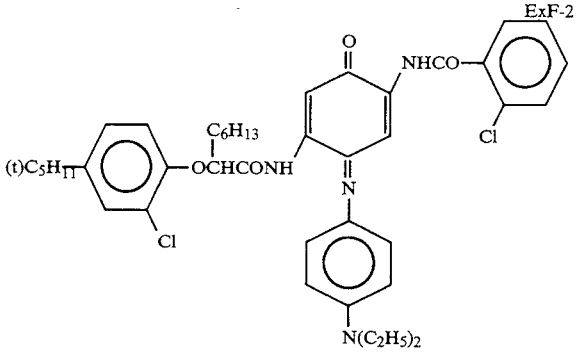
ExF-3
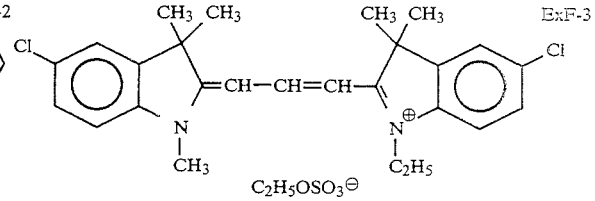
ExC-1
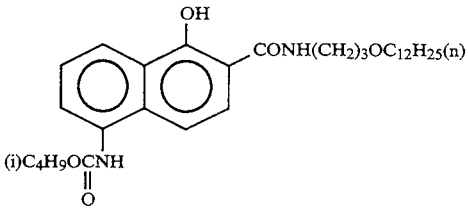
ExC-2
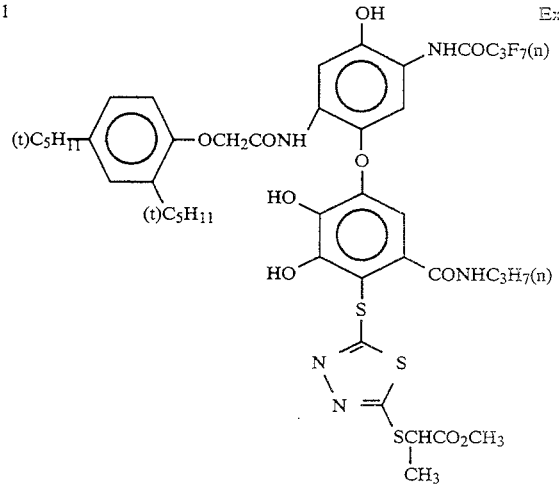
ExC-3
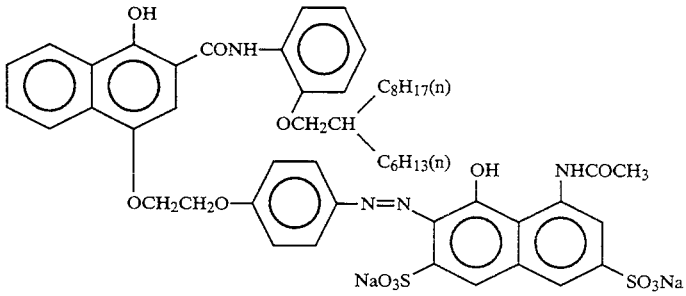
ExC-4
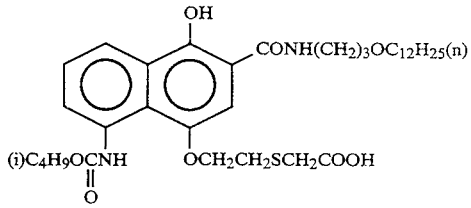
ExC-5
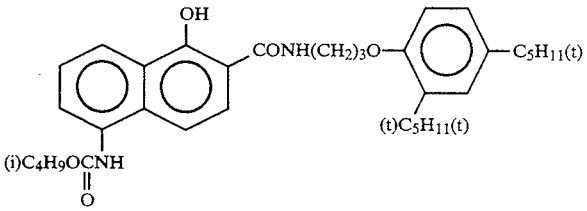

-continued
ExC-6
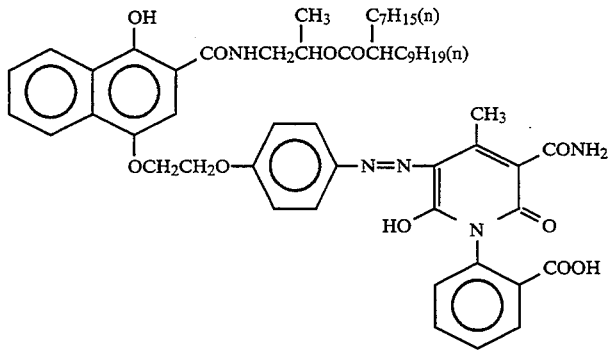
ExC-7
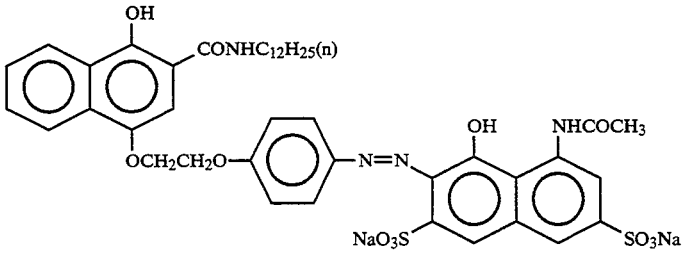
ExC-8
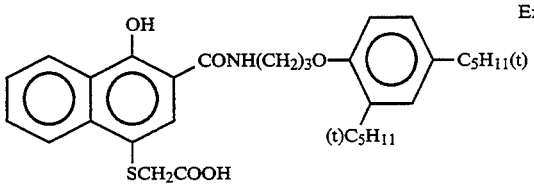
ExC-9
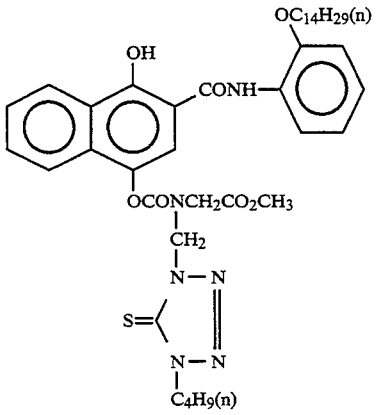
ExM-1
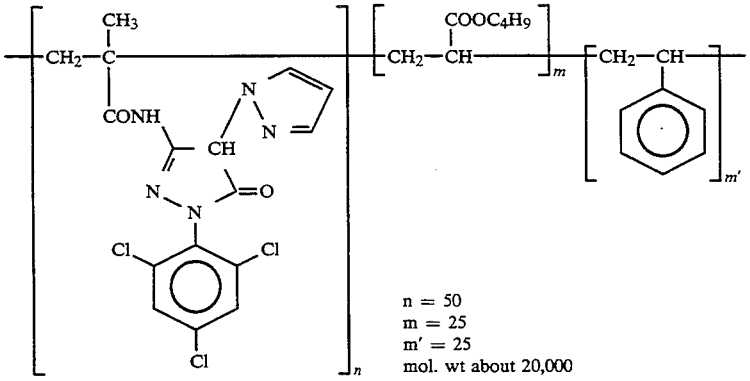

-continued
ExM-2
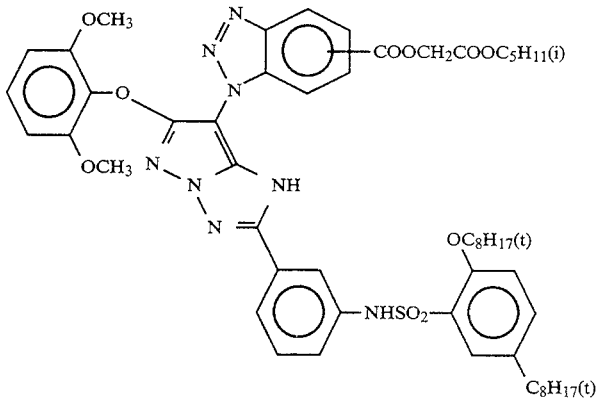
ExM-3
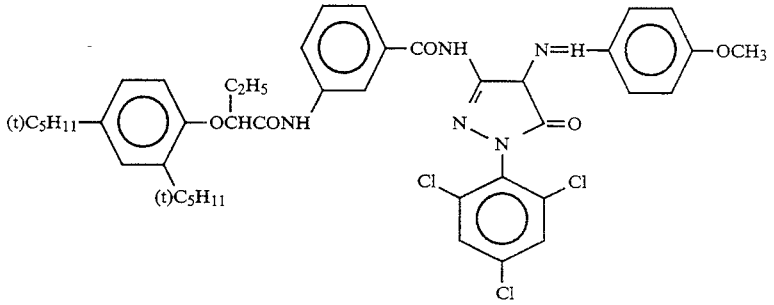
ExM-4
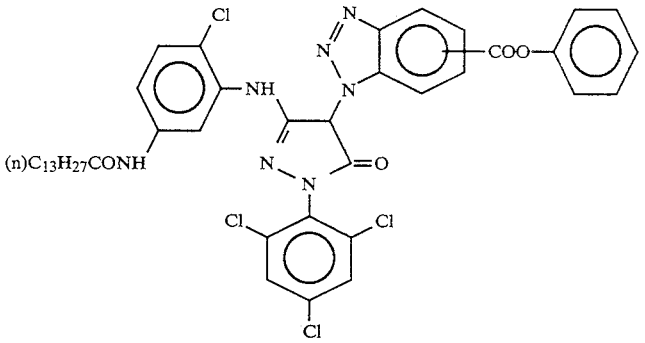
ExM-5
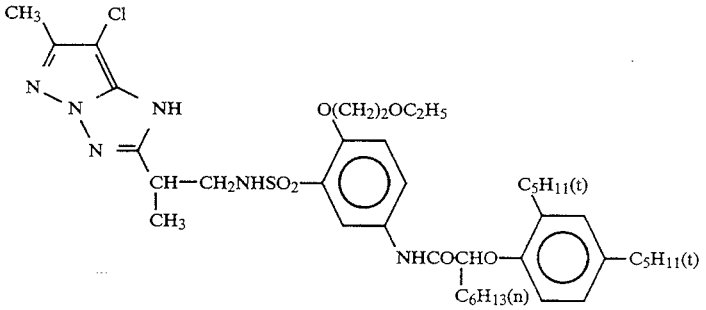

-continued
ExM-6
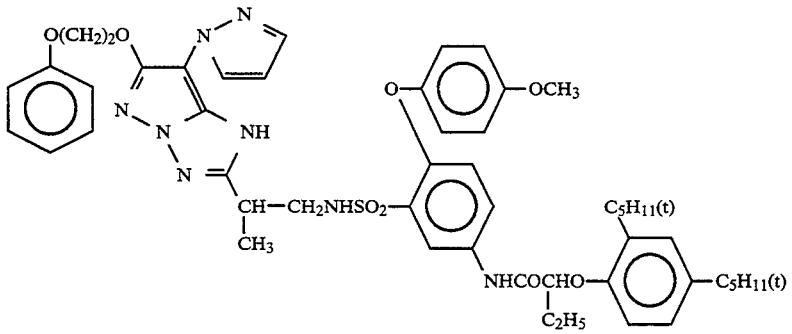
ExM-7
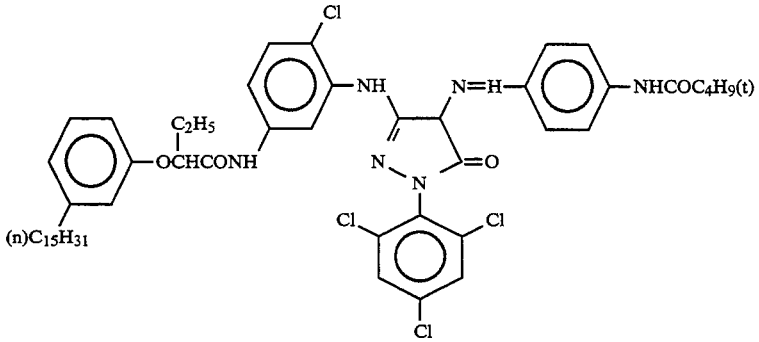
ExY-1
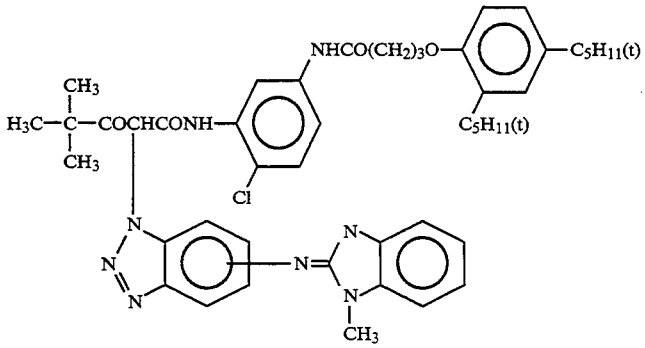
ExY-2
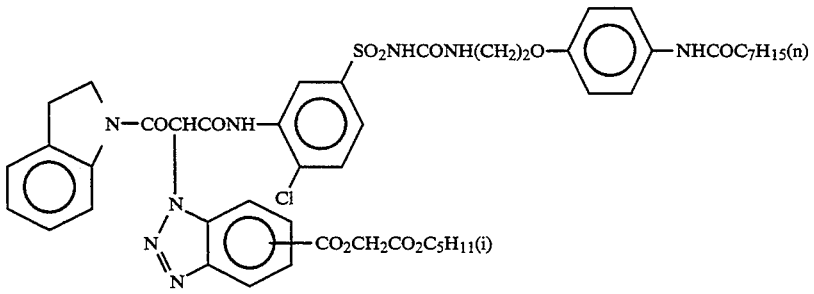
ExY-3
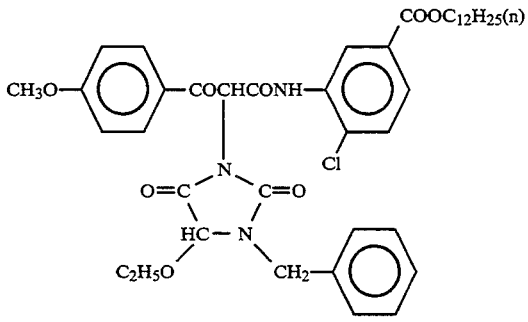

-continued
ExY-4
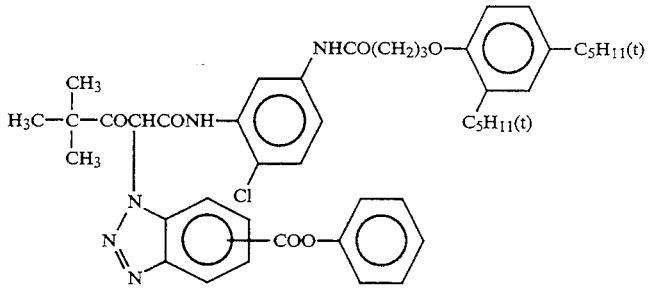
ExY-5
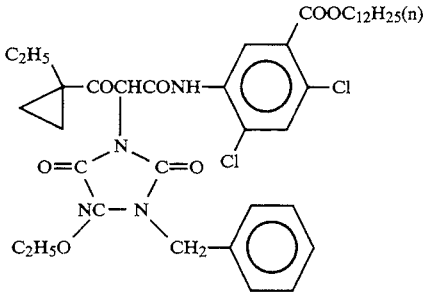
Cpd-1
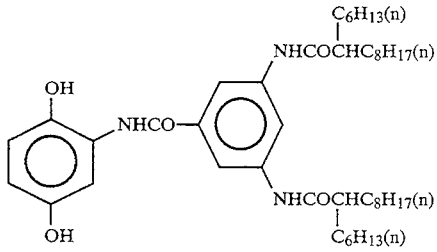
Cpd-2
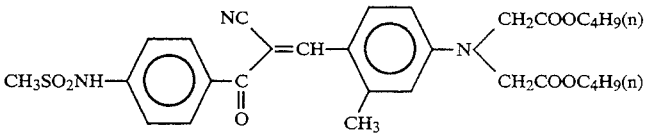
Cpd-3
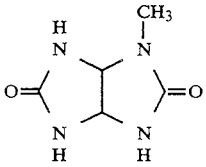
Cpd-4
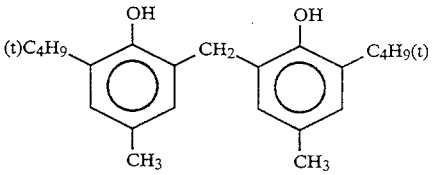
Cpd-5
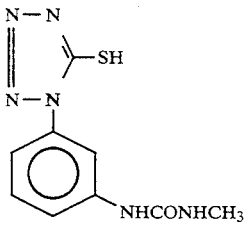
Cpd-6
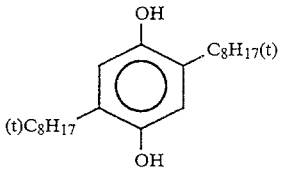
Solv-1
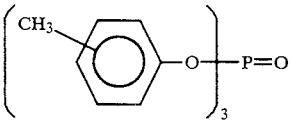
Solv-2
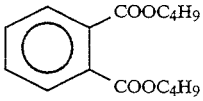
Solv-3
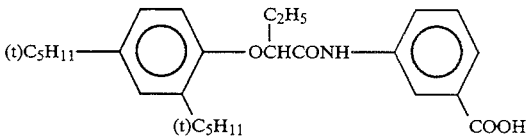
Solv-4
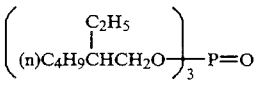
Solv-5
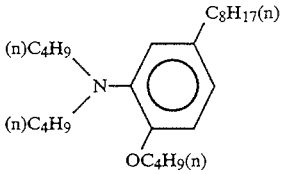

-continued
ExS-1
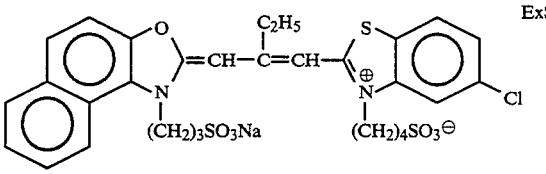
ExS-2
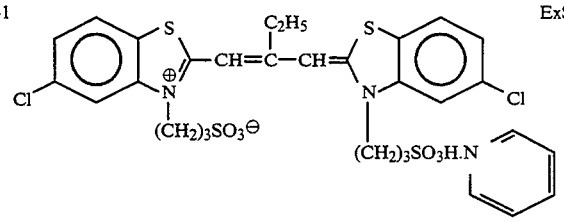
ExS-3
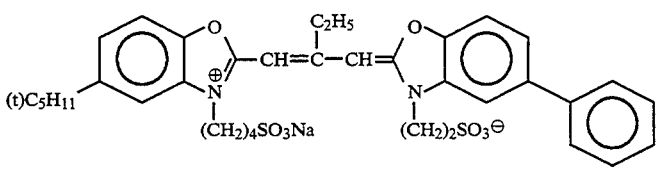
ExS-4
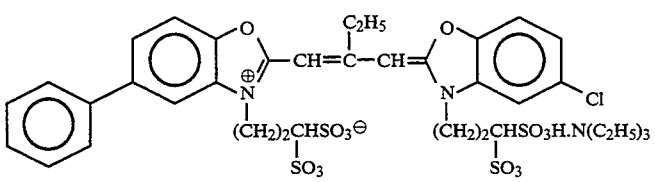
ExS-5
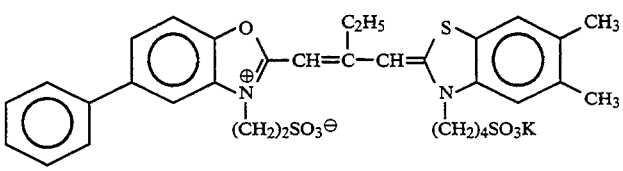
ExS-6
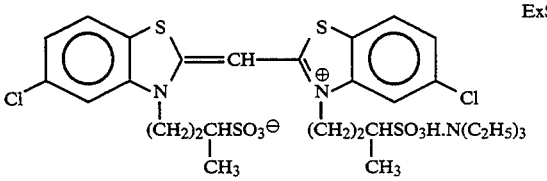
ExS-7
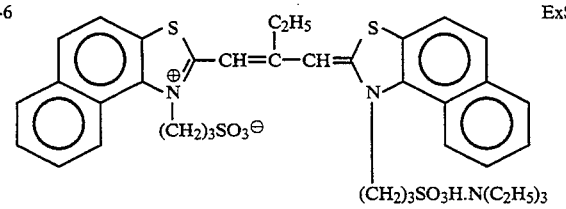
ExS-8
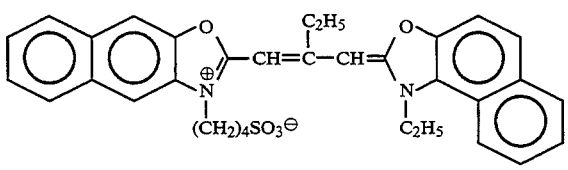
H-1
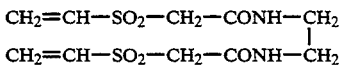
W-1
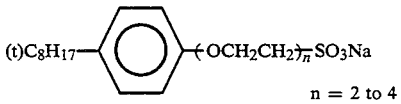
n = 2 to 4
W-2
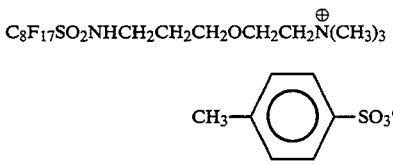
W-3
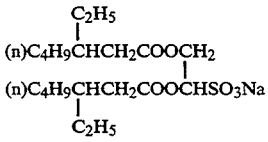
W-4
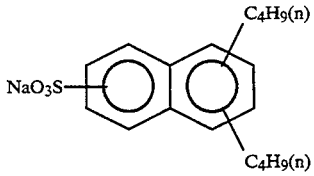

$C_8H_{17}SO_2N(C_3H_7)CH_2COOK$
-continued
W-5
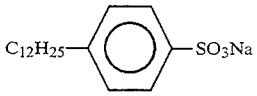
W-6
B-1
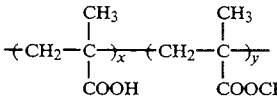
x/y = 10/90
B-2
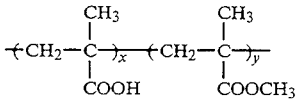
x/y = 40/60
B-3
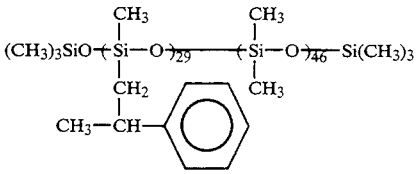
B-4
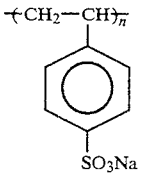
B-5
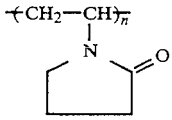
(mol. wt. about 10,000)
B-6
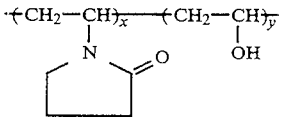
x/y = 70/30
F-1
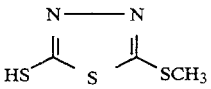
F-2
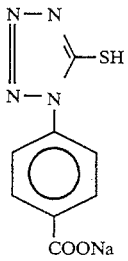
F-3
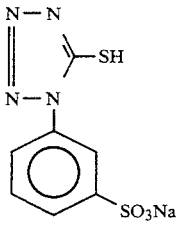
F-4
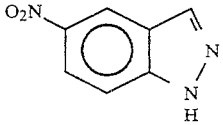
F-5
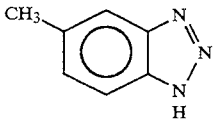
F-6
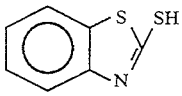
F-7
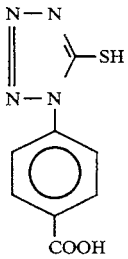
F-8
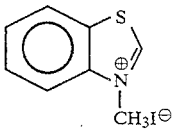
F-9
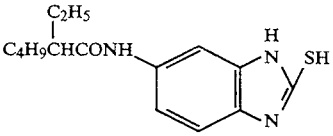
F-10
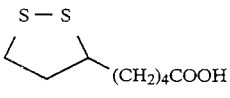

-continued

F-11

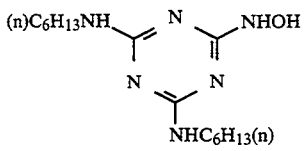

F-12

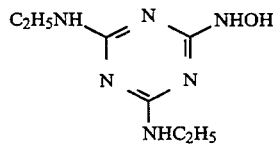

F-13

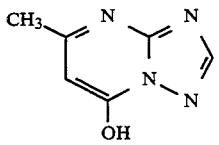

F-14

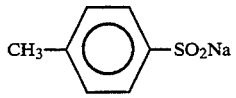

F-15

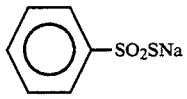

F-16

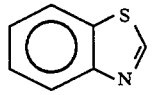

Samples 102 to 111 were made following the same procedures as for the sample 101 exception that the sensitizing dye and the coupler amount in the 10th layer and the yellow colloidal silver in the 11th layer of the sample 101 were changed as shown in Table 2 below. A list of the samples 101 to 102 is given in Table 2.

TABLE 2

| | | Sensitizing dye in 10th layer | | Coupler amount in 10th layer* | Compound in 11th layer |
|---|---|---|---|---|---|
| Sample | 101 | ExS-3 | $6.7 \times 10^{-4}$ | 100 | Yellow colloidal silver |
| | 102 | ExS-3 | $6.7 \times 10^{-4}$ | 98 | D-101 |
| | 103 | ExS-3 | $6.7 \times 10^{-4}$ | 98 | D-201 |
| | 104 | I-1 | $6.9 \times 10^{-4}$ | 95 | Yellow colloidal silver |
| | 105 | I-1 | $6.9 \times 10^{-4}$ | 91 | D-101 |
| | 106 | I-7 | $6.6 \times 10^{-4}$ | 96 | Yellow colloidal silver |
| | 107 | I-7 | $6.6 \times 10^{-4}$ | 89 | D-101 |
| | 108 | II-1 | $7.3 \times 10^{-4}$ | 96 | Yellow colloidal silver |
| | 109 | II-1 | $7.3 \times 10^{-4}$ | 88 | D-101 |
| | 110 | II-3 | $7.4 \times 10^{-4}$ | 96 | Yellow colloidal silver |
| | 111 | II-3 | $7.4 \times 10^{-4}$ | 90 | D-201 |

*The coupler amount in the 10th layer is represented by a relative value assuming that the coupler amount in the sample 101 is 100.

When the dye of the present invention was to be used in place of the yellow colloidal silver in the 11th layer, a material prepared by dissolving the dye in a solvent mixture of ethyl acetate and tricresylphosphate and dispersing the resultant material in an aqueous gelatin solution by using a colloid mill was used. The addition amount was $3.2 \times 10^{-4}$ mol/m$^2$ in all the examples. The coupler amount in the 10th layer was controlled such that a color formation quantity equivalent to that of the 10th layer of the sample 101 was obtained under white exposure.

These samples were subjected to the following color developing process.

| Process | Time | Temperature |
|---|---|---|
| Color development | 3 min. 15 sec. | 38° C. |
| Bleaching | 6 min. 30 sec. | 38° C. |
| Washing | 2 min. 10 sec. | 24° C. |
| Fixing | 4 min. 20 sec. | 38° C. |
| Washing | 3 min. 15 sec. | 24° C. |
| Stabilization | 1 min. 05 sec. | 38° C. |

The compositions of the processing solutions used in the individual steps were as follows.

| | |
|---|---|
| Color developing solution | |
| Diethylenetriaminepentaacetic acid | 1.0 g |
| 1-hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N-ethyl-N-β-hydroxylethylamino)-2-methylaniline sulfate | 4.5 g |
| Water to make | 1.0 l |
| pH | 10.0 |
| Bleaching solution | |
| Ferric ammonium ethylenediamine-tetraacetate | 100.0 g |
| Disodium ethylenediaminetetraacetate | 10.0 g |
| Ammonium bromide | 150.0 g |
| Ammonium nitrate | 10.0 g |
| Water to make | 1.0 l |
| pH | 6.0 |
| Fixing solution | |
| Disodium ethylenediaminetetraacetate | 1.0 g |
| Sodium sulfite | 4.0 g |
| Aqueous ammonium thiosulfate solution (70%) | 175.0 ml |
| Sodium bisulfite | 4.6 g |
| Water to make | 1.0 l |
| pH | 6.6 |
| Stabilizing solution | |
| Formalin (40%) | 2.0 ml |
| Polyoxyethylene-p-monononylphenylether (average polymerization degree 10) | 0.3 g |
| Water to make | 1.0 l |

When the samples 101 to 111 were wedge-exposed to white light and subjected to the processing (to be described later), samples with substantially equal sensitivities and gradations could be obtained.

The granularity of the magenta dye image of each resultant sample was measured by a conventional RMS (Root Mean Square) method. The determination of granularity according to the RMS method is known to those skilled in the art and described as an article titled "RMS Granularity; Determination of Just noticeable difference" in "Photographic Science and Engineering," Vol. 19, No. 4 (1975), pp. 235 to 238. An aperture of 48 fm was used in the measurement.

In addition, a dominant wavelength in reproduction of each of the samples 101 to 111 was obtained by the method described in JP-A-62-160448 for the purpose of evaluating the reproduction of wavelengths of a spectrum. That is, a difference $(\lambda-\lambda_0)$ between a wavelength $\lambda_0$ of testing light and a dominant wavelength $\lambda$ of a reproduced color was obtained at 450 to 600 nm, and the obtained values were averaged as follows:

$$\Delta\lambda = \frac{\int_{450}^{600} (\lambda - \lambda_0)d\lambda}{600 - 450}$$

The results are summarized in Table 3 below. The testing light was spectral light with an excitation purity of 0.7+white light. The exposure amount was 0.04 lux.sec and 0.01 lux.sec for the white light mixed. The latter value is supposed to better represent the characteristics of color reproduction in underexposure.

The obtained results are summarized in Table 3 below.

TABLE 3

| Sample No. | R, M, S of magenta D = fog + 0.3 ($\times 10^{-4}$) | D = fog + 0.8 ($\times 10^{-4}$) | $\Delta\lambda$ 0.04 Lux · sec | 0.01 Lux · sec | |
|---|---|---|---|---|---|
| 101 | 12 | 11 | 2.2 | 4.1 | Comparative example |
| 102 | 11 | 11 | 2.1 | 4.0 | Comparative example |
| 103 | 9 | 10 | 2.3 | 4.0 | Comparative example |
| 104 | 11 | 10 | 2.2 | 4.2 | Comparative example |
| 105 | 7 | 5 | 1.8 | 3.7 | Present invention |
| 106 | 9 | 9 | 2.0 | 3.9 | Comparative example |
| 107 | 5 | 5 | 1.7 | 3.3 | Present invention |
| 108 | 10 | 8 | 1.9 | 3.8 | Comparative example |
| 109 | 4 | 4 | 1.6 | 2.9 | Present invention |
| 110 | 9 | 8 | 2.0 | 3.9 | Comparative example |
| 111 | 6 | 4 | 1.7 | 3.2 | Present invention |

As is obvious from the results as shown in Table 3, each sample of the present invention could be improved significantly in granularity as compared with the comparative samples.

It was also found that the samples of the present invention were also very effective in color reproduction.

Example 2

Each of the samples 101 to 111 of Example 1 was processed into the form of an "UTSURUNDESU FLASH (tradename)" (Quick Snap) available from Fuji Photo Film Co., Ltd., and photography was performed by using each lens-incorporating film thus manufactured. When the results of photography were evaluated, it was found that each sample of the present invention exhibited a high print quality, indicating the obvious improving effect of the present invention.

What is claimed is:

1. A silver halide color photographic light-sensitive material comprising a support having provided thereon at least one blue-sensitive silver halide emulsion layer, at least one green-sensitive silver halide emulsion layer, at least one red-sensitive silver halide emulsion layer, and at least one hydrophilic colloid layer, wherein said hydrophilic colloid layer contains a compound represented by Formula (I) below, a silver halide emulsion layer having an interlayer effect on said red-sensitive layer is also provided, and said layer with the interlayer effect contains a silver halide emulsion spectrally sensitized with a sensitizing dye represented by Formula (III) below:

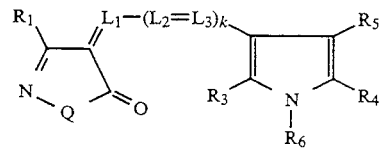

Formula (I)

wherein $R_1$ represents a hydrogen atom, alkyl, alkenyl, aryl, a heterocyclic ring, ureido, sulfonamide, sulfamoyl, sulfonyl, sulfinyl, alkylthio, arylthio, oxycarbonyl, acyl, carbamoyl, cyano, alkoxy, aryloxy, amino, or amide, Q represents —O— or —$NR_2$— wherein $R_2$ represents a hydrogen atom, alkyl, aryl, or a heterocyclic group, $R_3$, $R_4$, and $R_5$ each represent a hydrogen atom, alkyl, or aryl, and $R_4$ and $R_5$ being able to be bonded to each other to form a 6-membered ring, $R_6$ represents a hydrogen atom, alkyl, aryl, or amino, $L_1$, $L_2$, and $L_3$ each represent methine, and k is an integer of 0 or 1;

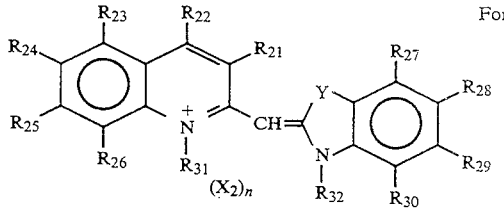

Formula III wherein $R_{21}$, $R_{22}$, $R_{23}$, $R_{24}$, $R_{25}$, $R_{26}$, $R_{27}$, $R_{28}$, $R_{29}$, and $R_{30}$ may be the same or different and each represent a hydrogen atom, a halogen atom, alkyl aryl, alkoxy, aryloxy, aryloxycarbonyl, alkoxycarbonyl, amino, acyl, cyano, carbamoyl, sulfamoyl, carboxyl, or an acyloxy group, $R_{31}$ and $R_{32}$ may be the same or different and each represent an alkyl group, Y represents a sulfur atom, a selenium atom, or an oxygen atom, $X_2$ represents a counter anion, and n is an integer of 0 or 1, and n=0 when an intramolecular salt is to be formed.

2. The silver halide color photographic light-sensitive material according to claim 1, wherein said sensitizing dye represented by Formula (III) is used together with another cyanine-based dye.

3. The silver halide color photographic light-sensitive material according to claim 1, wherein the respective silver halide emulsion layers comprise tabular grains having an aspect ratio of 3 to 20, which occupy 50% or more of the total projected area of all silver halide grains in a given emulsion layer.

4. The silver halide color photographic light-sensitive material according to claim 1, wherein, in said formula (III), Y represents a sulfur atom or an oxygen atom.

5. The silver halide color photographic light-sensitive material according to claim 1, wherein the addition amount of the sensitizing dye according to formula (III) is 20% or more of the amount of the dyes used in the layer with the interlayer effect.

6. The silver halide color photographic light-sensitive material according to claim 1, wherein the addition amount of the sensitizing dye according to formula (III) is $1\times10^{-5}$ to $2\times10^{-3}$mol per mol of silver halide.

7. The silver halide color photographic light-sensitive material according to claim 1, wherein the layer with the interlayer effect is arranged at any position provided that the layer is nearer to a support than the hydrophilic layer containing a compound represented by Formula (I).

* * * * *